US007648614B2

(12) United States Patent
Tran et al.

(10) Patent No.: US 7,648,614 B2
(45) Date of Patent: Jan. 19, 2010

(54) METHOD AND APPARATUS FOR CONTROLLING CROSS-MACHINE DIRECTION (CD) CONTROLLER SETTINGS TO IMPROVE CD CONTROL PERFORMANCE IN A WEB MAKING MACHINE

(75) Inventors: Peter Quang Tran, Dublin, OH (US); Kevin Dale Starr, Lancaster, OH (US); Timothy Andrew Mast, Dublin, OH (US)

(73) Assignee: ABB, Inc., Westerville, OH (US)

( * ) Notice: Subject to any disclaimer, the term of this patent is extended or adjusted under 35 U.S.C. 154(b) by 86 days.

(21) Appl. No.: 11/943,643

(22) Filed: Nov. 21, 2007

(65) Prior Publication Data

US 2008/0066884 A1 Mar. 20, 2008

Related U.S. Application Data

(62) Division of application No. 10/434,869, filed on May 9, 2003, now Pat. No. 7,300,548.

(51) Int. Cl.
*D21F 7/06* (2006.01)

(52) U.S. Cl. ..... 162/263; 162/198; 700/127; 700/128; 700/129

(58) Field of Classification Search ..... 162/263, 162/198; 700/127, 128, 129
See application file for complete search history.

(56) References Cited

U.S. PATENT DOCUMENTS

| | | | |
|---|---|---|---|
| 5,400,258 | A | 3/1995 | He |
| 5,898,589 | A | 4/1999 | Shakespeare et al. |
| 6,564,117 | B1 | 5/2003 | Chen et al. |

FOREIGN PATENT DOCUMENTS

| | | | |
|---|---|---|---|
| WO | 01/49931 | A1 | 7/2001 |

OTHER PUBLICATIONS

Tim Mast et al., New Optimization of CD Control for Global and Localized Profile Performance; Presented at 2003 Spring Technical Conference Proceedings of the Technical Association of the Pulp and Paper Industry; week of May 11, 2003; Chicago.

*Primary Examiner*—Mark Halpern
(74) *Attorney, Agent, or Firm*—Stevens & Showalter LLP

(57) ABSTRACT

A web making machine is monitored to identify at least one cross-machine direction (CD) actuator that is developing local mapping problems. The identified CD actuator and a segment of surrounding actuators are probed to determine a performance curve for the actuator. The center of an insensitivity region of the performance curve is selected as an optimal mapping alignment setting for the identified actuator with the setting for the actuator being updated. Global smoothing may also be accomplished by probing a global smoothness factor to generate a corresponding performance curve that is then similarly used to select an optimal value for the smoothness factor.

4 Claims, 10 Drawing Sheets

METHOD AND APPARATUS FOR CONTROLLING CROSS-MACHINE DIRECTION (CD) CONTROLLER SETTINGS TO IMPROVE CD CONTROL PERFORMANCE IN A WEB MAKING MACHINE

This application is a division of U.S. patent application Ser. No. 10/434,869 filed May 9, 2003, entitled METHOD AND APPARATUS FOR CONTROLLING CROSS-MACHINE DIRECTION (CD) CONTROLLER SETTINGS TO IMPROVE CD CONTROL PERFORMANCE IN A WEB MAKING MACHINE which is incorporated by reference herein in its entirety.

BACKGROUND OF THE INVENTION

The present invention relates in general to web forming processes and, more particularly, to improved cross-machine direction control of such processes. While the present invention can be applied to a variety of systems, it will be described herein with reference to a web-forming machine used for making sheets of paper for which it is particularly applicable and initially being utilized.

Uniformity of a property of a web of sheet material can be specified as variations in two perpendicular directions: the machine direction (MD), which is in the direction of web movement during production, and the cross-machine direction (CD), which is perpendicular to the MD or across the web during production. Different sets of actuators are used to control the variations in each direction. CD variations appear in measurements known as CD profiles and are typically controlled by an array of actuators located side-by-side across the web width. For example, in a paper making machine, an array of slice screws on a headbox or an array of white-water dilution valves distributed across a headbox are usually used to control the weight profiles of webs of paper produced by the machine.

Control schemes are used to control the CD actuators in order to reduce the variations at different CD locations across the web. For such schemes to succeed, it is crucial to apply control adjustments to the correct actuators, i.e., actuators that control areas of the web in which CD variations are to be reduced. Hence, the spatial relationship between the CD location of an actuator and the area of the profile the actuator influences is key to the implementation of a high-performance CD controller. The cross direction spatial relationship, between CD actuators and a CD profile, is known to those skilled in the art as "CD mapping". FIG. 1 shows an example of a CD mapping relationship 100 wherein bumps 102 made to actuators in an actuator array are reflected in the CD profile 106.

In many sheet-forming processes, the CD mapping relationship is not a linear function. For example, on a papermaking machine, the CD mapping between the headbox slice screws or dilution valves and weight profile is particularly non-linear near the edges of the web due to higher edge shrinkage. The nonlinear mapping relationship is a function of various machine conditions. The relationship cannot be easily represented with a fixed explicit function. Particularly in an ongoing web making operation where the CD mapping can change either gradually or abruptly, depending on the evolution of machine conditions.

Misalignment in the CD mapping can lead to deterioration in control performance. One typical symptom of mapping misalignment is the presence of sinusoidal variation patterns in both the CD profile and the actuator profile. The appearance of the sinusoidal pattern is often referred to in the art as a "picket fence" pattern or "pickets." The picket fence cycles that appear in both the CD profile and the actuator profile occur in the same region of the sheet and are usually of comparable spatial frequencies. Another typical symptom of mapping misalignment is the presence of sinusoidal variation patterns in the MD lanes corresponding to the sinusoidal variation patterns developed in both the CD profile and the actuator profile. The appearance of the sinusoidal pattern in the MD lanes in combination with the "picket fence" pattern is often referred to in the art as a "walking pattern". The patterns are caused by the control actions being applied to the misaligned actuators.

Although the mapping misalignment can be corrected by adjusting the control setup, often such adjustment has required manual intervention. Dependent on the frequency of CD mapping changes, the number of manual interventions may be significant. At a minimum, manual intervention requires determination of how wide the sheet is at the forming end (location of the process where the actuator array is situated) and at the finishing end (location of the process where the CD profiles are measured). While these determinations may be sufficient to satisfy processes with very minimal nonlinear shrinkage, for processes with greater non-linear shrinkage, the scope of manual intervention may require perturbing the actuator array, at multiple locations, to determine the mapping relationship between the actuators and the CD profile. Such perturbations or "bumps" are typically performed with the CD control system turned off. Additionally, only a few actuators, spaced sufficiently far apart, are normally perturbed at a given time to ensure separation of the response locations in the CD profile. For a CD control system with a large actuator array, such perturbations or bumps may consume an extended period of production on the process.

Automated on-line mapping misalignment correction has been proposed based on using global indicators, such as variability of the entire CD profile, to identify a plurality of misalignment problems across the web and to activate corresponding profile optimization sequences. See, for example, U.S. patent application Ser. No. 09/592,921, entitled AUTOMATED OPTIMIZATION OF CROSS MACHINE DIRECTION PROFILE CONTROL PERFORMANCE FOR SHEET MAKING PROCESSES, that was filed Jun. 13, 2000, is assigned to the same assignee as the present application, is incorporated herein by reference and is now U.S. Pat. No. 6,564,117. Unfortunately, if global indicators are used, local profile problem areas have to get to product damaging levels before corrective action can be taken and, since a plurality of problems are identified at a given time, problems that do not occur at that time are not addressed.

In addition, such correction schemes have assumed that the performance curve can be classified as a curve with a sharply defined minimum, such as a "V" shape. This form of performance curve has an optimal solution at the sharply defined minimum point. The inventors of the present application have determined that is not the case but rather, in cross direction applications, the performance curve is characterized by sharp edges and a wide, flat central region "_____/" such that the optimal point is near the center of the flat region and not near the sharply defined edges. Accordingly, previously proposed misalignment correction schemes find an optimal point at the sharply defined edges, which are points that are marginally stable. Further, a persistent "bad" spot in the profile resulting from mechanical problems can be identified as having a profile problem that needs to be probed resulting in time searching for a solution to a problem that cannot be solved.

It is also possible to control the smoothness of the setpoints of the actuator array, i.e., to restrict the setpoint differences between adjacent actuators in the actuator array, to reduce the amplitude of the cycles. Control of smoothness is also a mechanism for making the CD control system more robust for modeling uncertainty under different process conditions and the presence of uncontrollable variations in the CD profile.

Accordingly, there is an ongoing need in the art for improved cross-machine direction (CD) mapping control in web making machines that can overcome changes in the mapping relationships between CD actuators and the corresponding CD profile of the web that they control. The control arrangement would correct the mappings without interruption of the CD control system and preferably would also control the smoothness of the setpoints of the actuator array instead of or in addition to corrections of the mappings.

SUMMARY OF THE INVENTION

This need is currently met by the invention of the present application wherein a web making machine is monitored to identify at least one cross-machine direction (CD) actuator that is developing local mapping problems. The identified CD actuator and a segment of surrounding actuators are probed to determine a performance curve for the actuator. The performance curve is used to select an optimal mapping alignment setting for the identified actuator with the setting for the actuator being updated. Global smoothing may also be accomplished by probing a global smoothness factor to generate a corresponding performance curve that is then used to select an optimal value for the smoothness factor.

In accordance with one aspect of the present invention, a method for controlling cross-machine direction (CD) mapping in a web making machine comprises monitoring a web being produced by the web making machine and generating at least two web analysis profiles from data representative of the web. A first one of the at least two web analysis profiles is combined with a second one of the at least two web analysis profiles and the combination is used to identify a developing CD mapping problem. At least one CD actuator corresponding to the identified developing CD mapping problem is probed and an optimal performance point for the at least one CD actuator is determined from results of the probing. The CD mapping for the at least one CD actuator is adjusted in accordance with the optimal performance point.

Probing the at least one CD actuator corresponding to the identified developing CD mapping problem may comprise stepping mapping alignment for the at least one CD actuator being probed with mapping alignment steps beginning at an initial value. The web is monitored at each of the mapping alignment steps and a performance measure and tolerance limit is determined for the at least one CD actuator being probed for the current mapping alignment step. A stepping threshold is determined for the at least one CD actuator being probed based on data collected during all preceding mapping alignment steps.

Mapping alignment stepping is initially performed in a first direction and the probing may further comprise comparing the performance measure for the current mapping alignment step and the stepping threshold and stopping mapping alignment stepping in the first direction upon the performance measure exceeding the stepping threshold. The probing may further comprise setting a hard limit to the number of mapping alignment steps in the first direction and stopping mapping alignment stepping if the hard limit is met.

Probing may further comprise comparing the performance measure for the mapping alignment step at the initial value after mapping alignment stepping has terminated in the first direction and the stepping threshold and stopping further stepping if the performance measure for the mapping alignment step at the initial value exceeds the stepping threshold. If the performance measure for the mapping alignment step at the initial value does not exceed the stepping threshold, probing is performed in a second direction opposite to the first direction by stepping mapping alignment for the at least one CD actuator being probed with mapping alignment steps beginning at the initial value and proceeding in the second direction. The web is monitored at each of the mapping alignment steps in the second direction and a performance measure and tolerance limit is determined for the at least one CD actuator being probed for the current mapping alignment step in the second direction. A stepping threshold is determined for the at least one CD actuator being probed in the second direction based on data collected during all preceding mapping alignment steps in the second direction.

Probing in the second direction may further comprise comparing the performance measure for the current mapping alignment step for probing in the second direction and the stepping threshold for the at least one CD actuator being probed in the second direction and stopping mapping alignment stepping in the second direction upon the performance measure exceeding the stepping threshold for the at least one CD actuator being probed in the second direction. The probing may further comprise setting a hard limit to the number of mapping alignment steps in the second direction and stopping mapping alignment stepping in the second direction if the hard limit is met. The hard limit to the number of mapping alignment steps in the first direction may be equal to the hard limit to the number of mapping alignment steps in the second direction.

Generating at least two web analysis profiles may comprise generating a spatial analysis profile by defining a window corresponding to a number of data points generated by a sensor. The center of the window is aligned with each of a plurality of CD actuators in the web making machine to select sensor data local to the actuators and the sensor data within windows corresponding to the CD actuators is statistically processed to statistically map local data corresponding to the CD actuators into the spatial analysis profile. The statistical processing may comprise taking the variance of local data within the windows or taking the second order difference of local data within the windows.

The first one of the at least two web analysis profiles may be a spatial analysis profile and the second one of the at least two web analysis profiles may be a temporal analysis profile. The spatial analysis profile may be a spatial variance profile or a spatial second order difference profile. The first and second ones of the at least two web analysis profiles may be spatial analysis profiles with at least one of the first and second ones of the at least two web analysis profiles being a spatial variance profile and at least one of the first and second ones of the at least two web analysis profiles being a spatial second order difference profile. The first and second ones of the at least two web analysis profiles may be temporal profiles.

The method for controlling cross-machine direction (CD) mapping may further comprise generating a performance curve for the at least one CD actuator and the determination of an optimal performance point for the at least one CD actuator may comprise determining an insensitivity region of the performance curve; and defining the optimal performance point for the at least one CD actuator to be approximately the center of the insensitivity region of the performance curve.

In accordance with another aspect of the present invention, a method for controlling cross-machine direction (CD) mapping in a web making machine comprises monitoring CD actuators extending across the web making machine and generating at least two actuator analysis profiles from data representative of the CD actuators. A first one of the at least two actuator analysis profiles is combined with a second one of the at least two actuator analysis profiles to identify a developing CD mapping problem. At least one CD actuator corresponding to the identified developing CD mapping problem is probed and an optimal performance point is determined for the at least one CD actuator from probing results. The CD mapping for the at least one CD actuator is adjusted in accordance with the optimal performance point.

The first one of the at least two actuator analysis profiles may be a temporal analysis profile and the second one of the at least two actuator analysis profiles may be a spatial analysis profile. The spatial analysis profile may be a spatial variance profile or a spatial second order difference profile.

In accordance with yet another aspect of the present invention, a method for controlling cross-machine direction (CD) mapping in a web making machine comprises monitoring a web being produced by the web making machine and monitoring CD actuators extending across the web. At least two analysis profiles are generated from data representative of the web and data representative of the CD actuators. A first one of the at least two analysis profiles is combined with a second one of the at least two analysis profiles and a developing CD mapping problem from the combination. At least one CD actuator corresponding to the identified developing CD mapping problem is identified and an optimal performance point for the at least one CD actuator is determined from results of probing the at least one CD actuator. The CD mapping for the at least one CD actuator is adjusted in accordance with the optimal performance point. The first and second ones of the at least two analysis profiles may be generated from data representative of the web, from data representative of the CD actuators or the first one of the at least two analysis profiles may be generated from data representative of the web and the second one of the at least two analysis profiles may be generated from data representative of the CD actuators.

In accordance with still another aspect of the present invention, a method for controlling cross-machine direction (CD) mapping in a web making machine comprises monitoring a web making machine and identifying a developing CD mapping problem from data generated by the monitoring. At least one CD actuator corresponding to the developing CD mapping problem is identified and a performance curve is generated for the at least one CD actuator. An insensitivity region of the performance curve is identified and an optimal performance point is identified for the at least one CD actuator to be approximately the center of the insensitivity region of the performance curve.

The step of generating a performance curve may comprise probing the at least one CD actuator by stepping mapping alignment for the at least one CD actuator in a first direction with mapping alignment steps beginning at an initial value. A web being produced by the web making machine is monitored at each of the mapping alignment steps. A performance measure and tolerance limit is determined for the at least one CD actuator being probed for the current mapping alignment step. A stepping threshold is determined for the at least one CD actuator being probed based on data collected during all preceding mapping alignment steps with the performance measure for the current mapping alignment step being compared to the stepping threshold. Mapping alignment stepping in the first direction is stopped upon the performance measure exceeding the stepping threshold or a hard limit on the number of mapping alignment steps to be performed. The performance measure for the mapping alignment step at the initial value after mapping alignment stepping has terminated in the first direction is compared with the stepping threshold. Further stepping is stopped if the performance measure for the mapping alignment step at the initial value exceeds the stepping threshold. If the performance measure for the mapping alignment step at the initial value does not exceed the stepping threshold determined during probing in the first direction, probing in a second direction opposite to the first direction is performed by stepping mapping alignment for the at least one CD actuator with mapping alignment steps beginning at the initial value and proceeding in the second direction. The web is monitored at each of the mapping alignment steps in the second direction. A performance measure and tolerance limit for the at least one CD actuator being probed is determined for the current mapping alignment step in the second direction. A stepping threshold for the at least one CD actuator being probed in the second direction is determined based on data collected during all preceding mapping alignment steps in the second direction. The performance measure for the current mapping alignment step for probing in the second direction is compared with the stepping threshold for the at least one CD actuator being probed in the second direction. Mapping alignment stepping in the second direction is stopped upon the performance measure exceeding the stepping threshold for the at least one CD actuator being probed in the second direction or a hard limit on the number of mapping alignment steps to be performed.

In accordance with an additional aspect of the present invention, a method for controlling cross-machine direction (CD) mapping in a web making machine comprises monitoring a web making machine and generating at least two web analysis profiles from data representative of the web making machine. First and second ones of the at least two web analysis profiles are combined to identify a developing CD mapping problem. At least one CD actuator corresponding to the identified developing CD mapping problem is probed and an optimal performance point for the at least one CD actuator is determined from results of probing the at least one CD actuator. CD mapping for the at least one CD actuator is adjusted in accordance with the optimal performance point.

The step of monitoring a web making machine may comprise monitoring a web being produced by the web making machine, monitoring CD actuators extending across the web making machine or monitoring a web being produced by the web making machine; and monitoring CD actuators extending across the web making machine.

In accordance with a further aspect of the present invention, apparatus for controlling cross-machine direction (CD) mapping in a web making machine comprises a sensor for monitoring the web making machine and a controller programmed to perform the operations of: monitoring a web making machine; generating at least two web analysis profiles from data representative of the web making machine; combining a first one of the at least two web analysis profiles with a second one of the at least two web analysis profiles; identifying a developing CD mapping problem from the combination; probing at least one CD actuator corresponding to the identified developing CD mapping problem; determining an optimal performance point for the at least one CD actuator from results of probing the at least one CD actuator; and adjusting CD mapping for the at least one CD actuator in accordance with the optimal performance point.

The controller may perform the operation of monitoring a web being produced by the web making machine, the operation of monitoring CD actuators extending across the web making machine or the operations of monitoring a web being produced by the web making machine and monitoring CD actuators extending across the web making machine.

In accordance with yet still another aspect of the present invention, a method for controlling smoothness of setpoint settings of cross-machine direction (CD) actuators in a web making machine may comprise monitoring a web being produced by the web making machine and probing a global smoothing factor. A performance curve is generated for the global smoothing factor from the probing results. An optimal performance value is determined for the smoothing factor from the performance curve and the global smoothing factor is set to the optimal value. Probing a global smoothing factor may comprise stepping the global smoothing factor with steps beginning at an initial value. The web is monitored at each of the global smoothing factor steps and a performance measure and tolerance limit are determined for said global smoothing factor for the current smoothing factor step. A minimum performance measure and minimum tolerance limit for the global smoothing factor is determined based on data collected during a series of preceding mapping alignment steps.

Other features and advantages of the invention will be apparent from the following description, the accompanying drawings and the appended claims.

DETAILED DESCRIPTION OF THE INVENTION

Figure 1:
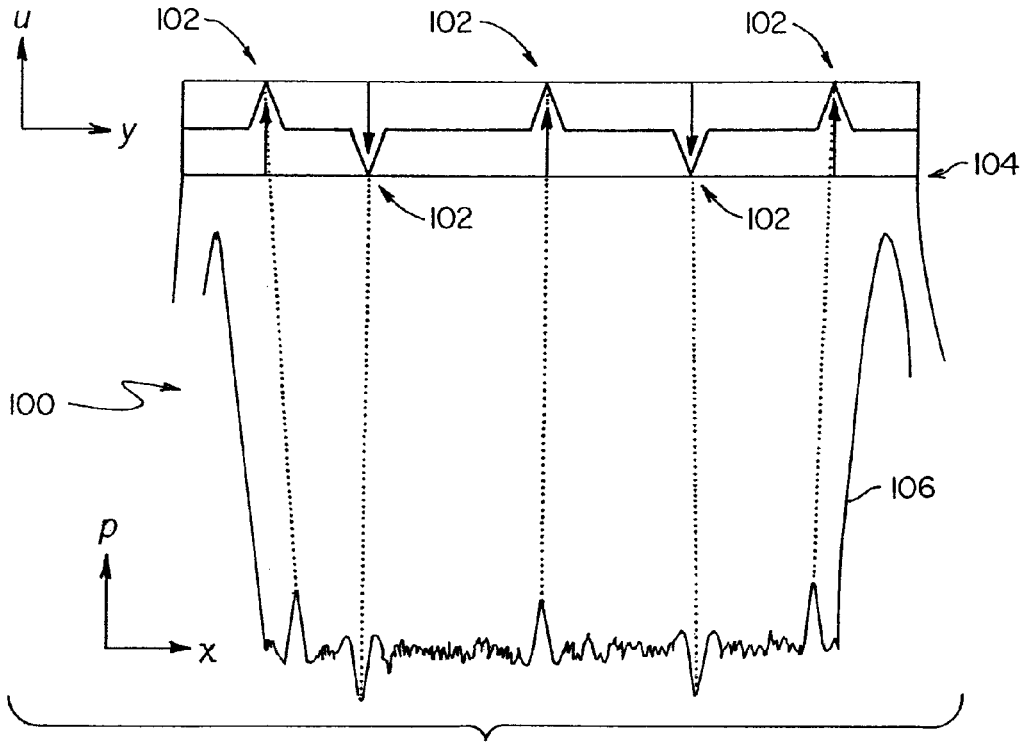
FIG. 1 shows an example of CD mapping between CD actuators and their corresponding regions of influence in a CD profile.
Figure 2:
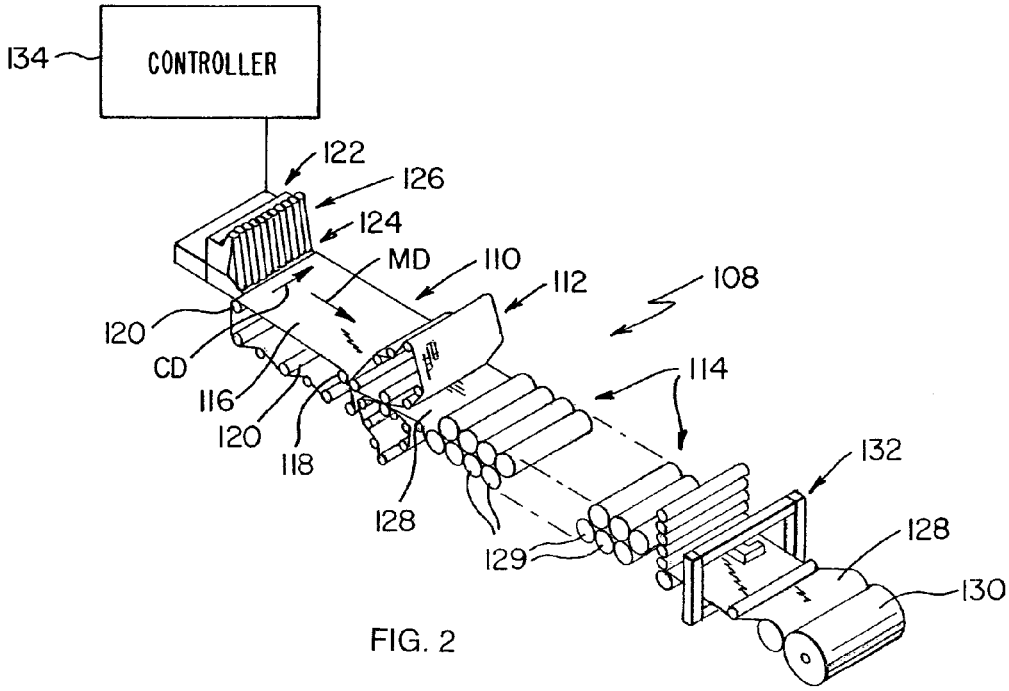
FIG. 2 is a perspective view of a paper-making machine operable in accordance with the invention of the present application.

The invention of the present application will now be described with reference to the drawings wherein FIG. 2 schematically illustrates a paper making machine 108 having a Fourdrinier wire section 110, a press section 112, a dryer section 114 having its midsection broken away to indicate that other web processing equipment, such as a sizing section, additional dryer sections and other equipment, well known to those skilled in the art, may be included within the machine 108.

The Fourdrinier wire section 110 comprises an endless wire belt 116 wound around a drive roller 118 and a plurality of guide rollers 120 properly arranged relative to the drive roller 118. The drive roller 118 is driven for rotation by an appropriate drive mechanism (not shown) so that the upper side of the endless wire belt 116 moves in the direction of the arrow labeled MD that indicates the machine direction for the process. A headbox 122 receives pulp slurry, i.e. paper stock, that is discharged through a slice lip 124, controlled using a plurality of CD actuators 126, slice screws as illustrated in FIG. 2 although dilution valves can also be used, onto the upper side of the endless wire belt 116. The pulp slurry is drained of water on the endless wire belt 116 to form a web 128 of paper. The water drained from the pulp slurry to form the web 128 is called white-water that contains pulp in a low concentration and is collected under the Fourdrinier wire section 110 and recirculated in the machine 108 in a well known manner.

The web 128 so formed is further drained of water in the press section 112 and is delivered to the dryer section 114. The dryer section 114 comprises a plurality of steam-heated drums 130. The web 128 may be processed by other well known equipment located in the MD along the process and is ultimately taken up by a web roll 130. Equipment for sensing characteristics of the web 128, illustrated as a scanning sensor 132 in FIG. 2, is located substantially adjacent to the web roll 130. It is noted that other forms of sensing equipment can be used in the invention of the present application including stationary sensing equipment for measuring part or the entire web 128 and that sensing equipment can be positioned at other locations along the web 128.

As previously mentioned, misalignment of the CD mapping in the machine 108 can lead to deterioration in CD control performance resulting, for example, in sinusoidal patterns often referred to as "picket fence" patterns or "pickets." Also, a sinusoidal pattern in the MD lanes in combination with the "picket fence" patterns can result in patterns often referred to in the art as "walking patterns". The invention of the present application overcomes CD mapping misalignment by recognizing individual local mapping misalignment problems as they occur, determining improved local CD control settings for each local mapping misalignment after it is detected and applying the improved CD control settings to fine tune a CD controller and thereby improve upon or correct the misalignment so that the CD controller will have improved and consistent long-term performance. The invention of the present application can also control the smoothness of the setpoints of the CD actuators instead of or in addition to corrections of the mappings. The CD control of the present application is preferably included within a controller 134 for the paper-making machine 108, although it can be included within a separate controller (not shown) coupled to the controller 134.

The control arrangement of the present application comprises the operations of profile monitoring, profile probing and profile correction. Profile monitoring uses pattern recognition to identify local profile actuator misalignment areas quickly. Once mapping misalignment areas have been identified, the areas are probed by adjusting CD control parameters to generate a profile performance curve. Once the profile performance curve is generated, the CD control parameters are updated to reflect the performance curve's optimal point.

Figure 3:
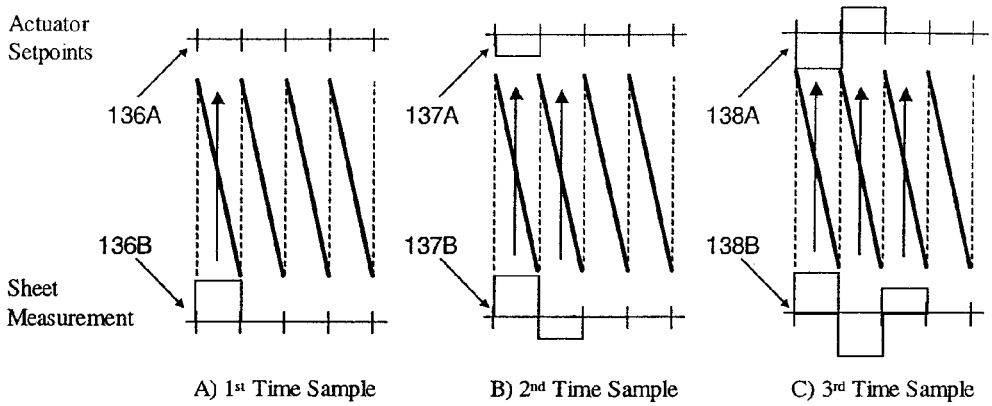
FIG. 3 is a graphical representation of mapping misalignment.

Mapping misalignment arises whenever the CD controller no longer has accurate information about CD mapping or actuator to profile alignment. An example is shown in FIG. 3 where the actuators and the profile have a one to one relationship. That is, when one actuator is moved, only one area of the profile having the width of the actuator is affected. In this example, three control actions are shown. The top images show the actuator positions, and the bottom images show the CD measurement of the sheet. The dotted lines represent the CD mapping for actuator and sensor profile alignment in the CD controller. The solid black diagonal lines represent actual actuator and sensor alignment.

In section A of FIG. 3, 136B shows the measurement when control is first turned on. The CD controller recognizes this error and makes a correction. The problem is that the CD controller adjusts an actuator to solve a profile problem, but the actuator change actually causes a problem in the next zone due to the misalignment. Since the mapping is off across all actuators shown, the mapping problem causes a "walking" pattern to appear. By the third control action 138B, the original error is still present, and now three more errors that were not present at the start have been introduced due to the CD mapping misalignment.

FIG. 3 illustrates only one example of a mapping mismatch. Of course other profile problems having differing degrees of severity can arise depending on the initial error and the type of actuator response that is applied by the CD controller. It is also noted that the mismatch of FIG. 3 presumes a global mapping problem wherein all the actuators are mismatched, which is the worst case. This is often not the case. Rather, in most cases, the mapping alignment problem is local and limited to only the locally affected areas.

The human eye can detect areas of the web where local mapping misalignments are present. Unfortunately, the web cannot be visually observed all the time and visual detection of misalignment problems is possible only after misalignment problems have persisted for a significant period of time. In addition to the web itself, the actuator profile, i.e., the actuator settings, corresponding to web production provides additional information regarding CD mapping misalignment.

Depending on the process gain relationship between the CD profile and the CD actuators, a mapping misalignment, such as a walking pattern, can be more easily seen in the sensor profile or in the actuator profile. If the process gain is large, then small actuator changes result in large process changes. In that event, the sensor profile shows mapping misalignment sooner than the actuator profile. On the other hand, if the process gain is small, then the actuator profile shows mapping misalignment sooner than the sensor profile. As a result, looking at only one without the other can result in delays in mapping misalignment identification.

Since the web cannot be visually observed all the time and visual observation detects mapping misalignments problems only after the problems have been present for some time, continuous mathematical analysis is provided by the mapping control of the present application to substitute for the eye. Indeed, this analysis improves upon the sensing abilities of the eye by detecting alignment mismatch problems sooner than could be detected by the eye and correcting the problems oftentimes before the eye can even detect that a problem is present.

Monitoring aspects of the mapping control of the present application include the step of analysis, the step of evaluating persistence of the analysis results, and the step of applying rules to combine the persistence evaluations to identify CD actuators with developing CD mapping problems. Monitoring is performed continuously to identify CD actuators that are aligned with an area of the web that has a mapping problem. After a CD actuator having a mapping problem has been identified and probing starts on that CD actuator, a segment of CD actuator positions surrounding the identified CD actuator being probed is removed from the scope of the CD picking aspect of monitoring, i.e., cannot be picked for probing. The other remaining CD actuators continue to be evaluated and, if any of the other actuators show up as having mapping problem during the on-going probing operations, they are added as new probing actuators. The monitoring continues until all CD actuators are removed from the scope of the picking aspect of monitoring. After probing has been completed on the current set of picked CD actuators, the monitoring process is reset so that monitoring operations may once again be performed on the entire web.

In the analysis step, analysis profiles are formulated from CD control information having high correlation to CD mapping problems. In the present application, the high-resolution CD error profile and the CD actuator setpoints are examples of CD control information that have high correlation to CD mapping problems.

The high-resolution CD error profile is a column vector representing deviations of the full-width CD sensor profile from a full-width CD target profile. The high-resolution error profile can be defined by the equation $$e(x,z)=p(x,z)-p_r(x,z) \tag{1}$$

where

- x=m-element vector of contiguous CD position for the full-width web or sheet of paper. The elements of x are often referred to as the CD profile databox numbers (or simply CD databoxes) or lane numbers.
- z=current data sample.
- e(x,z)=column vector representing the full-width, high-resolution CD error profile.
- $e(x_i,z)$=element of e(x,z) representing error in the sheet property at CD databox $x_i$.
- p(x,z)=column vector representing the full-width, high-resolution CD sensor profile.
- $p(x_i,z)$=element of p(x,z) representing the sheet property at CD databox $x_i$.
- $p_r(x,z)$=column vector representing the full-width, high-resolution CD target profile.
- $p_r(x_i,z)$=element of $p_r(x,z)$ representing the target value at CD databox $x_i$.

The high-resolution CD error profile, e(x,z), and high-resolution CD sensor profile, p(x,z), are updated periodically. For a scanning measurement system, this update occurs when the sensor housed in the scanning measurement system reaches the edge of the web or sheet. The high-resolution CD target profile, $p_r(x,z)$, updates when a user changes the target profile.

From the high-resolution CD error profile, a mapped CD error profile is formulated by aligning the high-resolution CD error profile with the CD actuators. The mapped CD error profile is a column vector with the same number of elements as there are CD actuators. By having the mapped CD error profile at the resolution of the CD actuators, the actuator number corresponding to the profile region with a mapping misalignment can be directly picked by the monitoring operation of the present application. The high-resolution CD error profile is transformed to the mapped CD error profile by the equation $$e_m(y,z)=M\cdot F\cdot e(x,z) \tag{2}$$

where

- y=n-element vector of contiguous CD actuators. The elements of y are often referred to as the CD actuator zone numbers.
- z=current data sample.
- $e_m(y,z)$=column vector representing the mapped CD error profile.
- e(x,z)=column vector representing the full-width, high-resolution CD error profile.
- F=an anti-aliasing filter matrix with m-columns and m-rows.
- M=mapping matrix for transforming the high-resolution CD error profile to the mapped CD error profile. The mapping matrix has n-rows and m-columns.

The filter matrix F serves the purpose of removing high frequency variations in the high-resolution CD error profile before the re-sampling operation of matrix M is performed to produce the mapped CD error profile. If F is a band-diagonal matrix, then the non-zero band-diagonal elements of F define a two-sided low-pass filter window. For those skilled in the art, the non-zero elements in matrix F can be computed from accepted windowing filters such as Hanning, Hemming, and Blackman.

The mapping matrix M is non-square. For all rows of the matrix M, if row j contains a single element $m_{ji}$ equal to the value one (1) and all other elements in the same row equal to the value zero (0), then the mapping matrix maps the filtered value of the high-resolution CD error profile corresponding to the CD databox $x_i$ to the CD actuator $y_j$ of the mapped CD error profile. For all rows of the matrix M, if row j contains a range of contiguous elements centered about element $m_{ji}$ having a sum of the range of contiguous elements equal to the value one (1) and all other elements not included in the range of contiguous elements equal to the value zero (0), then the mapping matrix is a two-sided low-pass filter that maps the range of CD databoxes corresponding to the range of contiguous elements centered about element $m_{ji}$ in the high-resolution CD error profile to the CD actuator $y_j$ of the mapped CD error profile.

Figure 4:
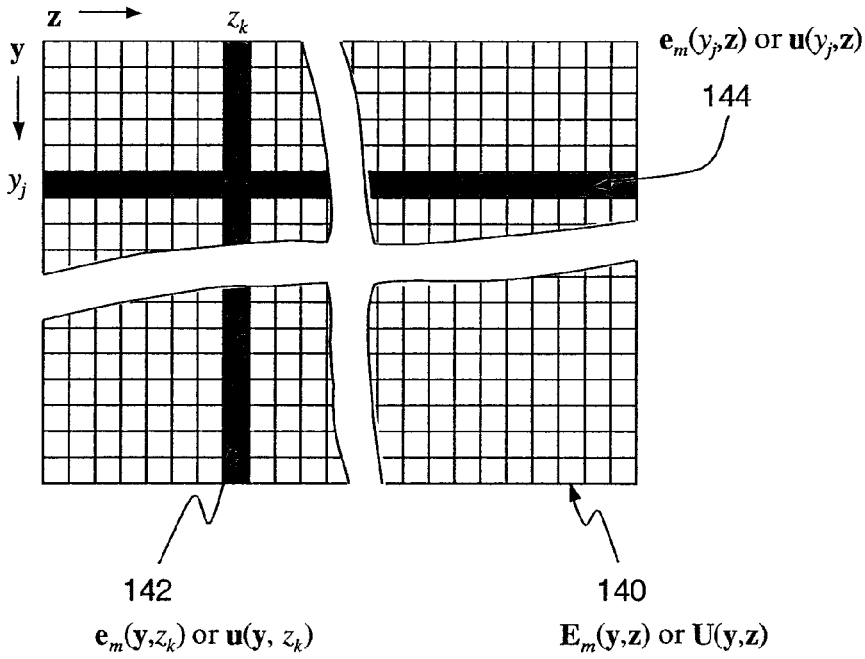
FIG. 4 shows the history of a mapped CD error profile represented by a matrix.

In the analysis step of the monitoring operation, a history of the mapped CD error profile is necessary to establish the presence of a mapping misalignment problem that results in what is often referred to as a "walking" pattern. For this step in the monitoring operation, the mapped CD error profile is stored in a circular buffer. A circular buffer is a storage method that first shifts data currently stored in the buffer by one register in the direction of historic data before introducing the new data. A history of the mapped CD error profile can be represented by a matrix $E_m(y,z)$ 140, as shown as an example in FIG. 4. As previously defined, the variable y is a vector of contiguous CD actuator numbers. The variable z is an s-element vector of consecutive updates of the mapped CD error profile. The elements of z are often referred to as data samples or updates, such that $z_o$, or z, is the current data sample and $z_k$ is the data sample received k updates prior to z. In the present application, the number of elements s in z is defined by the user to specify the extent of the temporal data to be analyzed. The column $e_m(y,z_k)$ 142, as shown in FIG. 4, is an element of matrix $E_m(y,z)$ and is a column vector representing the mapped CD error profile stored k updates prior to the most current update. The row $e_m(y_j,z)$ 144, as shown in FIG. 4, is also an element of matrix $E_m(y,z)$ and is a row vector representing the mapped CD error profile value at CD actuator $y_j$ for all samples of the mapped CD error profiles.

The CD actuator profile is a column vector representing the setpoint values for each of the CD actuators. The actuator setpoint values can be represented by a vector u(y,z). The variable y is a vector of contiguous CD actuator numbers. The variable z is the current sample of the actuator setpoints. The element $u(y_j,z)$, of u(y,z), represents setpoint value for CD actuator $y_j$.

It is typical for the CD actuator setpoints to update periodically with a periodicity equal to an integer number of the CD error profile updates, with the update period specified by a user. For example, the CD actuator setpoints may be updated after every fifth update of the CD error profile. However, for use in the monitoring operation of the present application, the CD actuator setpoints are sampled at the same frequency as the CD error profile update. This introduces coordination between the CD error profile and the CD actuator setpoints.

Similar to analysis performed on the mapped CD error profile, a history of the CD actuator setpoints is needed for the monitoring operation. A history of the mapped CD error profile can be represented by a matrix U(y,z). The variable y is a vector of contiguous CD actuator numbers. The variable z is a vector of consecutive samples of the CD actuator setpoints. The time horizon of z in U(y,z) is the same as that appearing in $E_m(y,z)$ in order to maintain coordination between the history of the mapped CD error profile and the CD actuator setpoints. The element $u(y,z_k)$, of matrix U(y,z), is a column vector representing the CD actuator setpoint values stored k updates prior to the most current update. The element $u(y_j,z)$, of matrix U(y,z), is a row vector representing the CD actuator setpoint values at CD actuator $y_j$ for all samples of the CD actuator setpoint values.

Based on the mapped CD error profile and the CD actuator setpoints, the analysis step includes the execution of statistical operations to formulate analysis profiles that provide insights into spatial (CD profile) and temporal (MD history) characteristics of the mapping misalignment problems. Formulation of the analysis profile can be defined by the generalized equation $$a(y,W,v)=W\cdot v(y) \tag{3}$$

where

- v(y)=column vector representing a conditioned input vector.
- W=analysis profile transformation matrix.
- y=n-element vector of contiguous CD actuators.
- a(y,W,v)=analysis profile of input v transformed by matrix W.

While certain transformations are described below to derive the analysis profiles considered in the present application, it should be understood that other transformations are possible to provide insights into mapping misalignment problems. While the mapped CD error profile and the CD actuator setpoints are different types of information related to CD control, the previously developed variables $e_m(y,z)$ and $u(y,z)$, and $E_m(y,z)$ and $U(y,z)$ are similar in structure. For illustrative purposes, the following development of analysis profiles will be applied to the mapped CD error profile. For those skilled in the art, the same development can be easily extended to the CD actuator setpoints or any other input that can be characterized with the same structure as $e_m(y,z)$ or $u(y,z)$, and $E_m(y,z)$ or $U(y,z)$.

A spatial variance analysis profile is a column vector represented by $a_s(y,W_s,v)$ and is defined as a profile of windowed variance at each CD location of the input profile. The spatial variance analysis profile is derived by convolving an equally-weighted squared mean window with the input vector. In Equation 3, the spatial variance analysis profile is derived by executing the following steps to define the conditioned input vector $v(y)$ and the spatial variance transformation matrix $W_s$:

1. The step of removing the mean value from the input vector $e_m(y,z)$ and assigning the result to an intermediate column vector $q(y,z)$ $$q(y,z) = e_m(y,z) - \frac{1}{n} O \cdot e_m(y,z) \tag{4}$$

$$O = \begin{bmatrix} 1 & \dots & 1 \\ \vdots & \ddots & \vdots \\ 1 & \dots & 1 \end{bmatrix}$$

where $e_m(y,z)$=column vector representing the input vector (for example, the mapped CD error profile).

n=number of elements in the input vector.

$q(y,z)$=intermediate column vector with the number of elements equal to the number of elements in the input vector and representing the input vector with its mean removed.

O=square matrix with the number of rows and columns equal to the number of elements in the input vector. All elements $o_{ij}$ in matrix O are equal to the value of one (1).

2. The step of creating the conditioned input vector $v(y)$, where the element $v(y_j)$ is equal to the squared value of corresponding element $q(y_j,z)$ of vector $q(y,z)$.

$$v(y)=[q^2(y_j,z)] \tag{5}$$

3. The step of creating the spatial variance transformation matrix $W_s$ where the element $w_{ij}$ is defined by Equation 6. $W_s$ is a square matrix with the number of rows and columns equal to the number of elements in the input vector. The variable $D_{sva}$ is a single-sided weighting length used to define an equally-weighted window. If the single-sided weighting length $D_{sva}$ is set too small, there will not be enough data to warrant a statistically valid variance profile. If the single-sided weighting length $D_{sva}$ is set too large, then the local spatial problems will be heavily filtered. A good starting value is to set the single-sided weighting length $D_{sva}$ to a value such that the length is equal to 5 to 10 actuators.

$$w_{ij} = \frac{1}{\min(n, i + D_{sva}) - \max(1, i - D_{sva}) + 1}, \quad \text{if } \max(1, i - D_{sva}) \le j \le \min(n, i + D_{sva}) \tag{6}$$
$$= 0, \quad \text{otherwise}$$

4. The step of computing the spatial variance analysis profile $a_s(y,W_s,v)$.

$$a_s(y,W_s,v)=W_s \cdot v(y) \tag{7}$$

A spatial second order difference analysis profile is a column vector represented by $a_d(y,W_d,v)$ and is defined as a profile of windowed spatial second order difference at each CD location of the input profile. The spatial second order difference analysis profile is derived by convolving a three element window with the input vector. In Equation 3, the spatial second order difference analysis profile is derived by executing the following steps to define the conditioned input vector $v(y)$ and the spatial second order difference transformation matrix $W_d$:

1. The step of setting the conditioned input vector $v(y)$ equal to the input vector $e_m(y,z)$.

$$v(y)=e_m(y,z) \tag{8}$$

2. The step of creating the spatial second order difference transformation matrix $W_d$ is defined by Equation 9. $W_d$ is a band-diagonal square matrix with the number of rows and columns equal to the number of elements in the input vector.

$$W_d = \begin{bmatrix} -1 & 1 & 0 & \dots & 0 \\ 1 & -2 & \ddots & \ddots & \vdots \\ 0 & \ddots & \ddots & \ddots & 0 \\ \vdots & \ddots & \ddots & -2 & 1 \\ 0 & \vdots & 0 & 1 & -1 \end{bmatrix} \tag{9}$$

3. The step of computing the spatial variance analysis profile $a_d(y,W_d,v)$.

$$a_d(y,W_d,v)=w_d \cdot v(y) \tag{10}$$

A temporal variance analysis profile is a column vector represented by $a_t(y,W_t,v)$ and is defined as a profile of variance at each CD location over the history matrix of the input vector. The temporal variance analysis profile is derived by computing the variance of s-samples at each CD location and assigning the resultant variance value to the element of $a_t$ corresponding to the CD location. In Equation 3, the temporal variance analysis profile is derived by executing the following steps to define the conditioned input vector $v(y)$ and the transformation matrix $W_t$:

1. The step of removing the mean value from the input vector $e_m(y_j,z)$ at CD position $y_j$, a row vector element of matrix $E_m(y,z)$, and assigning the result to an intermediate row vector $q(y_j,z)$ $$q(y_j,z) = e_m(y_j,z) - \frac{1}{s} e_m(y_j,z) \cdot O \tag{11}$$

$$O = \begin{bmatrix} 1 & \dots & 1 \\ \vdots & \ddots & \vdots \\ 1 & \dots & 1 \end{bmatrix}$$

where $e_m(y_j,z)$=row vector representing the sample history of the input vector at CD position $y_j$ (for example, the mapped CD error profile).

s=number of history elements in the input vector.

$q(y_j,z)$=intermediate row vector with the number of elements equal to the number of elements in the input vector $e_m(y_j,z)$ and representing the input vector with its mean removed.

O=square matrix with the number of rows and columns equal to the number of elements in the input vector. All elements $o_{ij}$ in matrix O are equal to the value of one (1).

2. The step of creating the conditioned input vector element $v(y_j)$, where the element $v(y_j)$ is equal to the summed, squared value of elements $q(z_k)$ of vector q(z).

$$V(y_j)=q(y_j,z)q^T(y_j,z) \tag{12}$$

3. The step of creating the conditioned input vector v(y) by repeatedly performing steps 1 and 2 for all $y_j$ elements in y.
4. The step of creating the transformation matrix $W_t$ that is the identity matrix, pre-multiplied by the reciprocal of the number of elements in the input vector v(y). Matrix $W_t$ is defined by Equation 13. W is a square matrix with the number of rows and columns equal to the number of elements in the input vector.

$$W_t = \frac{1}{s}\cdot\begin{bmatrix} 1 & 0 & \dots & 0 \\ 0 & \ddots & \ddots & \vdots \\ \vdots & \ddots & \ddots & 0 \\ 0 & \dots & 0 & 1 \end{bmatrix} = \frac{1}{s}\cdot I \tag{13}$$

5. The step of computing the spatial variance analysis profile $a_t(y,W_d,v)$.

$$a_t(y,W_p,v)=W_t\cdot v(y) \tag{14}$$

For the temporal variance analysis profile, storing s-elements of the input vector may be limited by the available system memory. For limited memory systems, a recursive form of the temporal variance, employing a forgetting factor, can also be applied to the MD histories on a per lane basis. For one skilled in the art, the equation for the temporal variance analysis profile can be transformed from a matrix form to a summation form as seen in Equation 15.

$$\bar{e}_m(y_j) = \frac{1}{s}\sum_{k=0}^{s-1} e_m(y_j, z_k)] \tag{15}$$

$$a_t(y_j, z) = \frac{1}{s}\sum_{k=0}^{s-1} [e_m(y_j, z_k) - \bar{e}_m(y_j)]^2$$

where $e_m(y_j,z_k)$=scalar representing the mapped CD profile at position $y_j$ and at time $z_k$.

s=number of history elements in the input vector.

The addition of a decaying weighting factor to Equation 15 yields a second form which diminishes the contribution of older values in the summation and allows the gradual removal of older information. This new form is shown in Equation 16.

$$a_t(y_j, z) = \frac{1}{T_d}\sum_{k=0}^{s-1} \exp\left(-\frac{s-k}{T_d}\right)\cdot[e_m(y_j, z_k) - \bar{e}_m(y_j)]^2 \tag{16}$$

where $e_m(y_j,z_k)$=scalar representing the mapped CD profile at position $y_j$ and at time $z_k$.

s=number of history elements in the input vector.

$T_d$=user defined decay value.

The advantage equation 16 is that it can be calculated recursively from previous values. This allows for continuous calculation of the temporal variance analysis profile without the need for storage of the s-element memory buffer needed for Equation 15. Using standard recursive techniques known to one skilled in the art, the next value of the sequence defined in Equation 16 is defined in Equation 17.

$$\begin{aligned} \bar{e}_m(y_j, z) &= \exp\left(-\frac{1}{T_d}\right)\cdot\bar{e}_m(y_j, z_{k-1}) + \frac{1}{T_d}\cdot e_m(y_j, z_k) \\ \beta(y_j, z_k) &= \exp\left(-\frac{1}{T_d}\right)\cdot\beta(y_j, z_{k-1}) + \frac{1}{T_d}\cdot e_m^2(y_j, z_k) \\ \gamma(y_j, z_k) &= \exp\left(-\frac{1}{T_d}\right)\cdot\gamma(y_j, z_{k-1}) + \frac{1}{T_d} \\ a_t(y_j, z_k) &= \beta(y_j, z_k) + [\bar{e}_m(y_j)]^2[\gamma(y_j, z_k) - 2] \end{aligned} \tag{17}$$

where $e_m(y_j,z_k)$=scalar representing the mapped CD profile at position $y_j$ and at time $z_k$.

s=number of history elements in the input vector.

$T_d$=user defined decay value.

This recursion will produce a very close approximation of the actual temporal variance analysis profile without the need for buffering of the s-element history matrix.

From the foregoing and the following table:

| Input | Analysis Applied, W v | Output, a(W, v) |
|---|---|---|
| Mapped CD Error Profile | Spatial Variance | Spatial Variance Analysis of Mapped CD Error Profile |
| Mapped CD Error Profile | Temporal Variance | Temporal Variance Analysis of Mapped CD Error Profile |
| Spatial Variance Analysis of Mapped CD Error Profile | Temporal Variance | Temporal Variance Analysis of Spatial Variance Analysis of Mapped CD Error Profile |
| Mapped CD Error Profile | Spatial Second Order Difference | Spatial Second Order Difference Analysis of Mapped CD Error Profile |
| CD Actuator Setpoints | Temporal Variance | Temporal Variance Analysis of CD Actuator Setpoints |
| CD Actuator Setpoints | Spatial Second Order Difference | Spatial Second Order Difference Analysis of CD Actuator Setpoints |

it is apparent that the analysis portion of profile monitoring as illustrated in the present application results in the generation of six analysis profiles: spatial variance analysis of mapped CD error profile, temporal variance analysis of mapped CD error profile, temporal variance analysis of spatial variance analysis of mapped CD error profile, spatial second order difference analysis of mapped CD error profile, temporal variance analysis of CD actuator setpoints, and spatial second order difference analysis of CD actuator setpoints.

A normalized analysis profile $\alpha(y,z)$ is calculated by first removing the mean value of all elements in the analysis profile $a(y,W,v)$ from each element of the analysis profile and then dividing the resulting "zero-mean analysis profile" by the standard deviation of all elements in the corresponding analysis profile $$q = a(y, W, v) - \frac{1}{n} O \cdot a(y, W, v) \tag{18}$$

$$O = \begin{bmatrix} 1 & \dots & 1 \\ \vdots & \ddots & \vdots \\ 1 & \dots & 1 \end{bmatrix}$$

$$a(y, z) = \sqrt{\frac{n}{q^T q}} \cdot q$$

where $a(y,W,v)$=analysis profile.

n=number of elements in the analysis profile.

q=intermediate column vector with the number of elements equal to the number of elements in the analysis profile.

O=square matrix with the number of rows and columns equal to the number of elements in the analysis profile. All elements $o_{ij}$ in matrix O are equal to the value of one (1).

Normalization of the analysis profiles, to generate the normalized analysis profiles, removes concerns of units from the analysis profiles. The values of the normalized analysis profiles represent a factor of the standard deviation of all elements in the analysis profile. For example, a value of two (2) for an element of the normalized analysis profile means that the element is two times the standard deviation of the analysis profile. If an area of the web represented by an element of the normalized analysis profile starts to exceed the persistence threshold (user selected or automatically set), then persistence is considered to exist for that element of the normalized analysis profile.

The persistence step, performed after the analysis profiles have been determined, generates a persistence profile $c(y,z)$ for each of the determined analysis profiles. The persistence profile $c(y,z)$ is a vector with the same number of elements as the analysis profile for which it is created. A persistence profile is the result of comparing the elements of a normalized analysis profile to either a user specified or an automatically set persistence threshold $L_{pt}$. A counting method is employed to update the elements of the persistence profile based on the comparison of corresponding elements in the normalized analysis profile to the persistence threshold. The element $c(y_j,z)$ of the persistence profile $c(y,z)$ represents a persistence count at CD position $y_j$.

A particular persistence profile $c(y,z)$ is updated based on comparison of the corresponding normalized analysis profile to the persistence threshold $L_{pt}$. The value of element $c(y_j,z)$ of the persistence profile is incremented by one (1) every time the value at CD position $y_j$ of the normalized analysis profile is above the persistence threshold. The value of element $c(y_j,z)$ of the persistence profile is decremented by one (1) every time the value at CD position $y_j$ of the normalized analysis profile is below the persistence threshold.

$$c(y,z_k)=c(y,z_{k-1})+sgn(\alpha(y,z_k)-L_{pt}) \tag{19}$$

Figure 5:
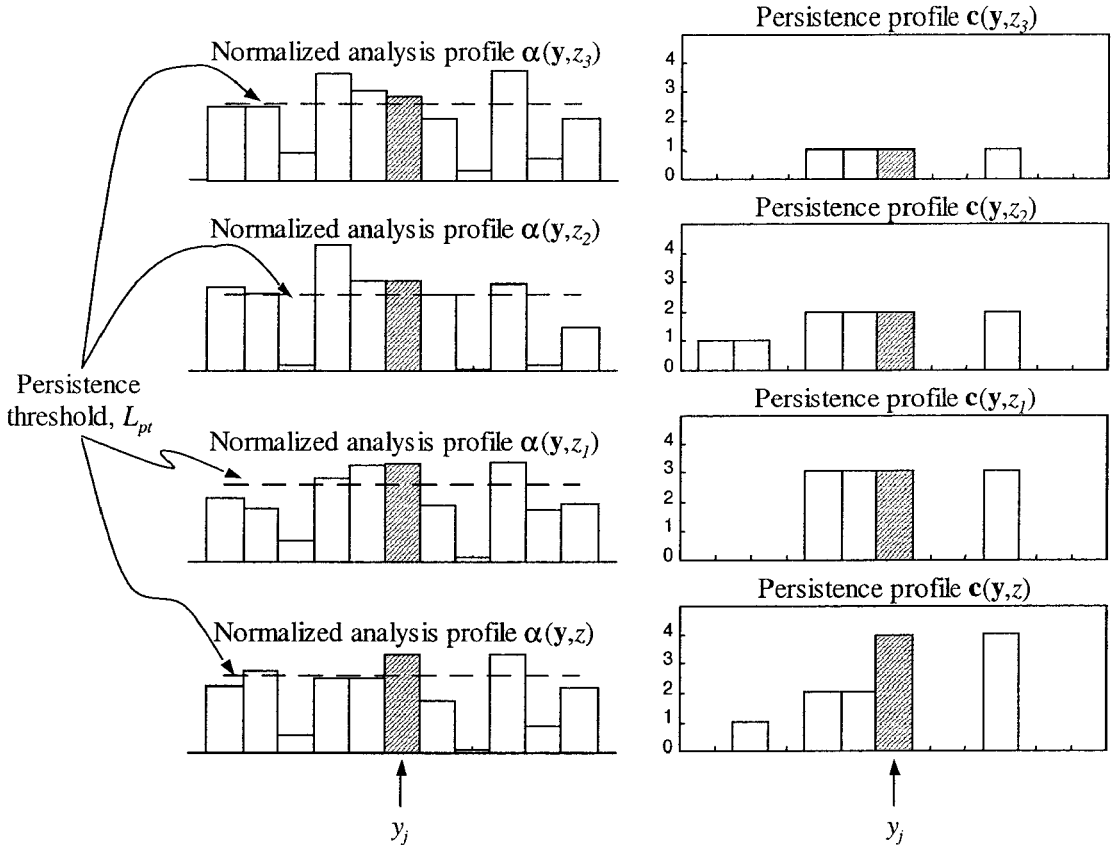
FIG. 5 illustrates a counting method employed for calculation of a persistence profile.

FIG. 5 illustrates the counting method employed where four scans of a normalized analysis profile illustrate calculation of a persistence profile. The persistence count of all elements in the persistence profile $c(y,z)$ are limited between zero and an upper limit to prevent "wind-up" of the persistence count. The upper limit is also set for the persistence count so as to prevent a single element of the persistence profile from triggering selection of a probing CD actuator in a following step, the step of applying the combining rules. As an example, the upper limit was set to be 1.5 times the persistence threshold, in a working embodiment of the present invention. The persistence profiles are tuned by setting the persistence threshold to a factor of the standard deviation of the analysis profiles. For example, a value of two (2) means that the normalized analysis profile has to have a section go above two times the standard deviation of the analysis profile before updating of a persistence profile is started.

The step of applying the combining rules, performed after the persistence profiles have been determined, generates a rules profile $c_r(y,z)$ from two different persistence profiles $c(y,z)$ and is used to pick CD actuators with developing CD mapping problems. The rules profile $c_r(y,z)$ is a vector with the same number of elements as the persistence profiles $c(y,z)$ for which it is created. A combination of logical and arithmetic operations are employed to update the elements of the rules profile based on a windowed area around corresponding elements in the two different persistence profiles. The rules profile is then compared to a user specified or an automatically set rules threshold $L_{rt}$. Once an element of the rules profile exceeds the rules threshold, a center-of-gravity operation is performed to pick a CD actuator. The picked CD actuator is then probed to find an improved mapping alignment.

In the illustrated embodiment, since there are six persistence profiles, one for each of the analysis profiles, a pairing of two different persistence profiles results in the calculation of fifteen (15) possible rules profiles with the user being able to enable or disable the calculation of one or more of the rules profiles. The rules profile(s) is then used to determine what area(s) of the profile has degraded, i.e., where alignment problems are developing across the web. Currently, rules profiles combine two different persistence profiles to reduce the chance for false identifications of alignment problems. It is contemplated that for given applications of the present invention, it will be possible to produce rules profiles from a single persistence profile or any combination (2, 3, etc.) of persistence profiles.

Figure 6:
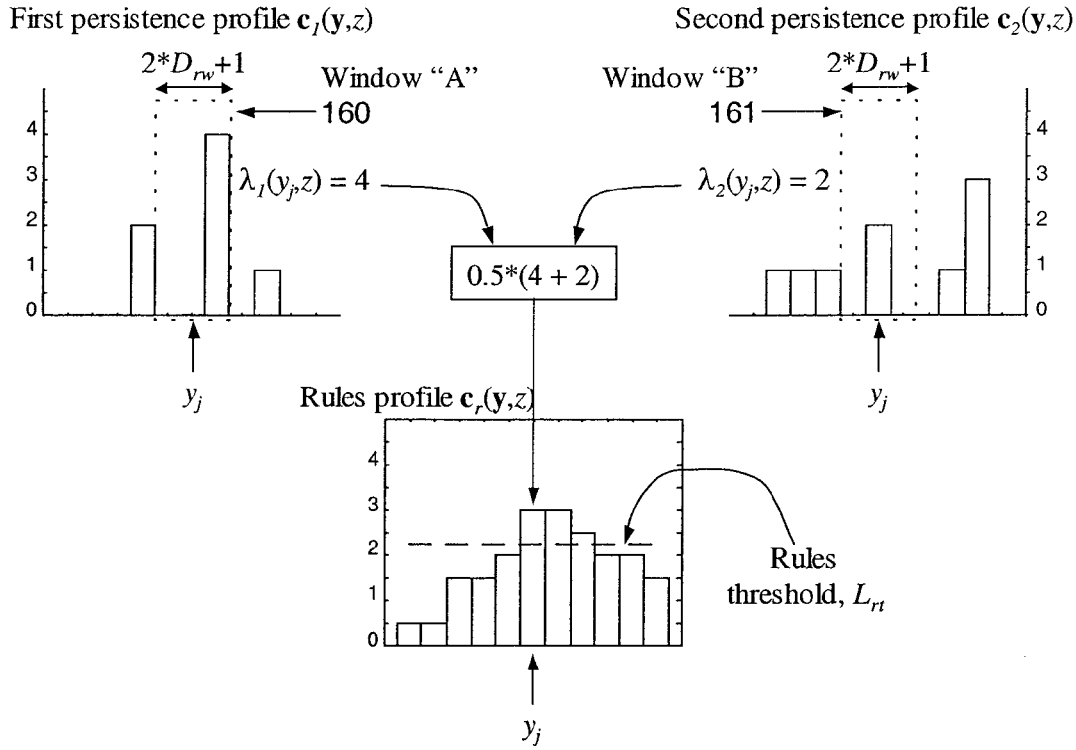
FIG. 6 illustrates an example of evaluation of two persistence profiles in accordance with rules of the present application.

Inputs for the calculation of the rules profiles are the persistence profiles. As mentioned above, currently, two different persistence profiles are used to generate each rules profile. For two arbitrarily chosen persistence profiles 1 and 2, a sliding window, with a user specified single-sided width $D_{rw}$, is superimposed on the vector $c(y,z)$ of the two persistence profiles. The sliding window is determined by adding one (1) to twice the value of $D_{rw}$ to yield a window that is equal to an odd number of elements in y. The sliding windows, represented by windows A 160 and B 161 in FIG. 6, are moved one element of y at a time along the vector $c(y,z)$ of each persistence profiles and aligned over the same $y_j$ elements of the two persistence profiles. At each CD position $y_j$, the maximum values in the persistence profiles within the two aligned windows A and B are determined as $$\lambda_1(y_j,z_k)=\max\{c_1(y_{j-D_{rw}},z_k),\ldots,c_1(y_j,z_k),\ldots,c_1(y_{j+D_{rw}},z_k)\}$$

$$\lambda_2(y_j,z_k)=\max\{c_2(y_{j-D_{rw}},z_k),\ldots,c_2(y_j,z_k),\ldots,c_2(y_{j+D_{rw}},z_k)\} \quad (20)$$

The maximum values for the two windows are added together and the average is taken to result in an entry in the rules profile at the CD location $y_j$ as illustrated in FIG. 6.

$$c_r(y_j, z_k) = \frac{\lambda_1(y_j, z_k) + \lambda_2(y_j, z_k)}{2} \quad (21)$$

In FIG. 6, the windows A and B are illustrated as being three actuators wide from a value of one (1) for $D_{rw}$; however, other odd numbers of actuators can be used as the sliding window size. As illustrated, the maximum of the three elements of window A is 4 and the maximum of the three elements of window B is 2 so that the sum of the maximums is 4+2=6. Since two windows are used, the average is 6 divided by 2 or 3 for the entry in the corresponding rules profile entry location that is centered on the windows A, B. The window then slides one actuator position and the next calculation is performed.

Inputs for the picking of CD actuators to probe are the rules profiles and the rules threshold $L_{rt}$. The rules threshold determines how long a problem has to be present before a CD actuator is picked for probing actions. If the rules threshold is set too low, false triggers may be generated. If the rules threshold is set too high, the profile may degrade seriously before a trigger is generated. The elements of each of the rules profiles $c_r(y,z)$ is compared to the rules threshold. Once an element $c_r(y_j,z)$ of the rules profile exceeds the rules threshold, a center-of-gravity calculation, over a user specified single-sided window length $D_{cog}$ around $y_j$, is performed to pick the CD actuator y*(h). As an example, in the current embodiment of the present application, the single-sided window length $D_{cog}$ is chosen over the range of 5 to 10 CD actuators. The nearest integer value resulting from the center-of-gravity calculation is the CD actuator y*(h)

$$y^*(h) = \text{round}\left(\frac{\sum_{l=y_j-D_{cog}}^{y_j+D_{cog}} [y_l \cdot c_r(y_l, z)]}{\sum_{l=y_j-D_{cog}}^{y_j+D_{cog}} c_r(y_l, z)}\right) \quad (22)$$

where $c_r(y_j,z)$=elements of rules profile that exceeds the rules threshold.

$D_{cog}$=single-sided window length in center-of-gravity calculation.

round( )=function rounding the input to the nearest integer value.

The picked CD actuator y*(h) is added to the set Y* and is then probed. The set Y* may have zero elements to $h_{total}$ elements, which is a set containing currently picked and all previously picked CD actuators corresponding to a CD profile region with a mapping problem. The variable h is the index of y*. In the illustrated embodiment, $h_{total}$ is a growing count of the total number of actuators that have been identified as having a mapping problem.

Once a CD actuator has been identified from the rules profiles, that CD actuator and a range of CD actuators, specified by the user as a single-sided window length $D_b$, are removed from the scope of the picking aspect of monitoring until such time as the probing process is completed for all actuators y*(h) in the set Y*. As an example, in the illustrated embodiment of the present application, the single-sided window length $D_b$ is chosen over the range of 5 to 10 CD actuators. CD actuators are removed from the scope of the picking aspect of monitoring by setting the value for the associated elements in all the rules profiles to zero (0). The range of CD actuators removed from the scope of the picking aspect of monitoring are chosen to satisfy $$1 \leqq y^*(h)-(2\cdot D_b) \leqq y_j \leqq y^*(h)+(2\cdot D_b) \leqq n \quad (23)$$

As noted, each rule can be enabled or disabled by the user. The rule pairs represent all combinations of the persistence profiles for the analysis profiles and generate as outputs actuator numbers to be probed. The rule pairs considered in the illustrated embodiment are presenting in the following table:

| Rule | Persistence Profile of First Analysis Profile | Persistence Profile of Second Analysis Profile |
|---|---|---|
| 1 | Spatial Variance Analysis of Mapped CD Error Profile | Temporal Variance Analysis of Spatial Variance Analysis of Mapped CD Error Profile |
| 2 | Spatial Variance Analysis of Mapped CD Error Profile | Spatial Second Order Difference Analysis of Mapped CD Error Profile |
| 3 | Spatial Variance Analysis of Mapped CD Error Profile | Temporal Variance Analysis of Mapped CD Error Profile |
| 4 | Spatial Variance Analysis of Mapped CD Error Profile | Spatial Second Order Difference Analysis of CD Setpoints |
| 5 | Spatial Variance Analysis of Mapped CD Error Profile | Temporal Variance Analysis of CD Setpoints |
| 6 | Temporal Variance of Spatial Variance Analysis of Mapped CD Error Profile | Spatial Second Order Difference Analysis of Mapped CD Error Profile |
| 7 | Temporal Variance of Spatial Variance Analysis of Mapped CD Error Profile | Temporal Variance Analysis of Mapped CD Error Profile |

-continued

| Rule | Persistence Profile of First Analysis Profile | Persistence Profile of Second Analysis Profile |
|---|---|---|
| 8 | Temporal Variance of Spatial Variance Analysis of Mapped CD Error Profile | Spatial Second Order Difference Analysis of CD Setpoints |
| 9 | Temporal Variance of Spatial Variance Analysis of Mapped CD Error Profile | Temporal Variance Analysis of CD Setpoints |
| 10 | Spatial Second Order Difference Analysis of Mapped CD Error Profile | Temporal Variance Analysis of Mapped CD Error Profile |
| 11 | Spatial Second Order Difference Analysis of Mapped CD Error Profile | Spatial Second Order Difference Analysis of CD Setpoints |
| 12 | Spatial Second Order Difference Analysis of Mapped CD Error Profile | Temporal Variance Analysis of CD Setpoints |
| 13 | Temporal Variance Analysis of Mapped CD Error Profile | Spatial Second Order Difference Analysis of CD Setpoints |
| 14 | Temporal Variance Analysis of Mapped CD Error Profile | Temporal Variance Analysis of CD Setpoints |
| 15 | Spatial Second Order Difference Analysis of CD Setpoints | Temporal Variance Analysis of CD Setpoints |

Profile probing will now be described. The basis for optimization of CD performance in a local region of the sensor profile is the performance of the CD control in that local region. If actuator alignment is correct for some arbitrary local region of the sensor profile centered on a particular actuator, in that local region, a well-tuned CD control will exhibit excellent performance and will produce none of the possible patterns associated with mapping misalignment. Local variability in the region will remain relatively stable, with only a few variations due to normal operation of the paper-making machine. If the mapping alignment for the actuator is shifted in a small region about the actuator, while the CD control remains active, the change in mapping alignment will have little or no effect. However, as the mapping alignment gets further from the correct value, local variability begins to increase. A plot of local variability for the region as the mapping alignment is swept through some range centered about the correct alignment results in a generally parabolic shape. An example of the generally parabolic shape 180 is shown in FIG. 7 wherein each black circle represents the nominal local variability in the region.

Figure 7:
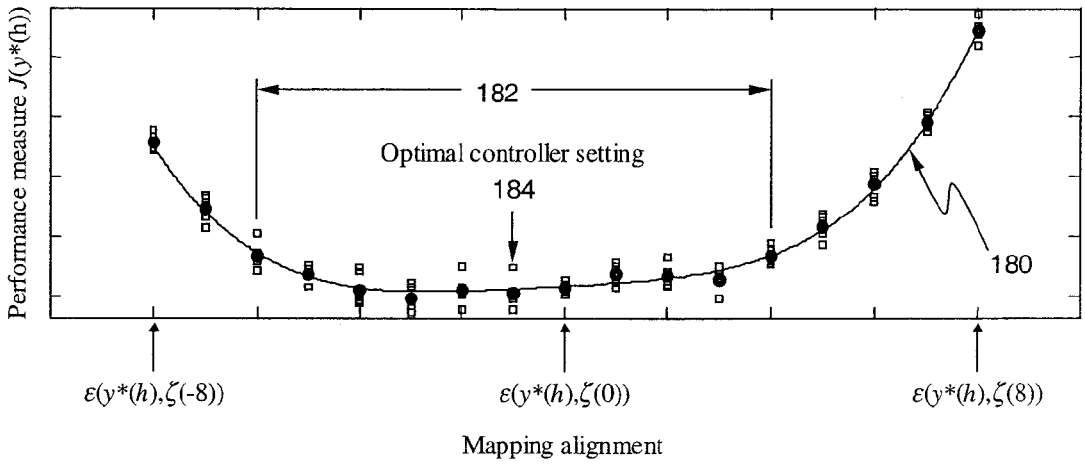
FIG. 7 illustrates a performance curve for a CD actuator produced using probing techniques of the present application.

An important feature of FIG. 7 is a generally flat region 182 in the middle of the generally parabolic shape 180. The flat region 182 is due to the effect of a well-designed CD controller that is insensitive to small errors in the actuator alignment. As long as the mapping alignment in the CD controller is close to the correct value, the controller performs well. This CD controller operation creates the generally flat region 182 that is substantially centered on the optimal alignment location 184. The flat region 182 is a region of CD controller "insensitivity." The recognition of the "insensitivity" region by the inventors of the present application is important because an optimization technique that correctly locates the optimal actuator mapping alignment during optimization will enable the controller to be more robust in the face of changing process conditions.

The "insensitivity" region is also significant due to the impact it has on many traditional optimization techniques that presume a performance curve has a minimum point that defines optimal mapping alignment. Applying this traditional presumption, the optimization parameter is changed until the performance value is no longer decreasing thus having reached its minimum. At this point, the optimization technique stops its operation with the corresponding value being determined to be the correct alignment value. Unfortunately, such a traditional optimization scheme does not work well since it finds the correct mapping alignment to be at a point where the performance curve stops decreasing. However, in the performance curve shown in FIG. 7, this results in an alignment value on the edge of the "insensitivity" region. Such a mapping alignment result yields satisfactory short-term performance, but is not an optimal solution. Slight change in the local shrinkage can easily move the non-optimal solution into an area where control performance begins to degrade. An optimal solution is at the center of the flat-portion 182 of the generally parabolic performance curve 180 where slight changes in actuator alignment due to process operation, such as changing shrinkage values, remains in the "insensitivity" region and continues to yield excellent control performance.

Figure 8:
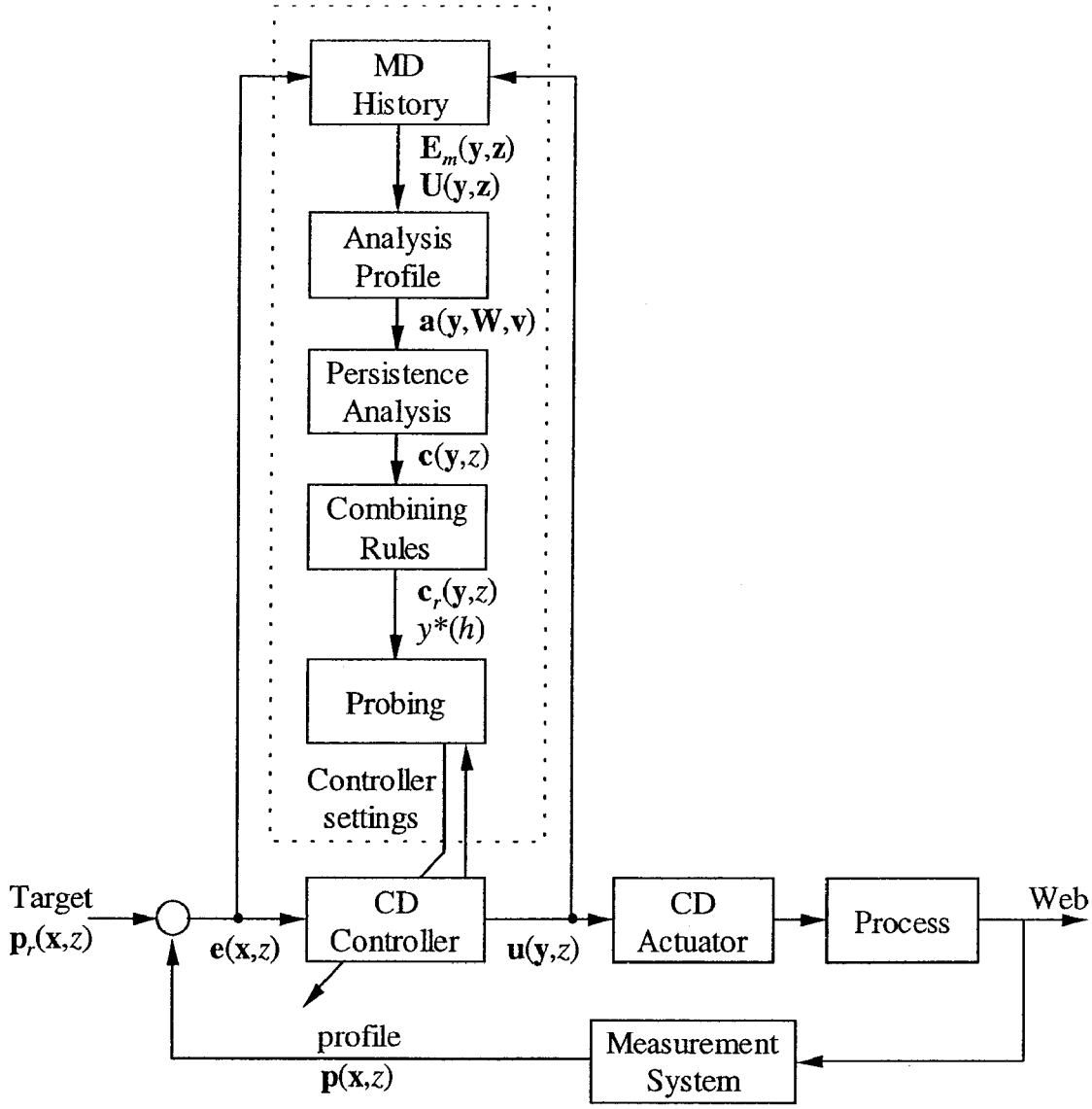
FIG. 8 is a block diagram showing the closed-loop optimization of the present application.

Using the concept of the local performance curve of the present application, the primary goal for optimization of local profile performance is the determination of optimal local mapping alignments. The optimization is performed to capitalize on the flatness of the performance curve in its "insensitivity" region. The optimization is performed closed-loop with the existing CD controller operating rather than being interrupted. This is important since the optimization routine determines the optimal mapping alignment based upon the closed-loop performance of the CD controller. Closed-loop optimization differs from most traditional techniques for the correction of mapping misalignment since they identify mapping alignment in an open-loop fashion. Unfortunately, the correct open-loop alignment may not be the same as the optimal mapping alignment identified using a closed-loop technique. In addition, open-loop identification techniques require that the CD controller be turned off for some period of time. A great advantage of closed-loop techniques is that control is maintained during the entire optimization period. FIG. 8 is a block diagram showing the closed-loop optimization of the present application.

The first step of profile probing is identification of the local region of CD actuators to be optimized for the newly picked CD actuator y*(h). The analysis steps described above provide an automated technique for determining one or more CD actuators y*(h) to be probed. It is also possible for the user to manually enter one or more CD actuators y*(h) to be probed. Probing operations must take into account that improper mapping alignment is a local phenomenon and that the region of a sheet that undergoes process changes, such as uneven drying and shrinkage, is not limited to the region of influence of a single actuator. Accordingly, a probing operation must account for the mapping alignments in the CD controller for a region rather than for a single actuator. The local region of CD actuators is identified by two extreme CD actuators, with the probed actuator y*(h) centered between the extreme CD actuators. The two extreme CD actuators are selected by a user specified single-sided spacing distance $D_p$ from the probed actuator y*(h) to yield the lower CD actuator range $y_L$*(h) and the upper CD actuator range $y_U$*(h), where $y_L$*(h) and $y_U$*(h) are calculated from equation $$y^*_L(h)=y^*(h)-(D_p+1)$$

$$y^*_U(h)=y^*(h)+(D_p+1) \tag{24}$$

The extreme CD actuators $y_L$*(h) and $y_U$*(h) are referred to as "pinning" actuators. In a working embodiment, the default spacing distance $D_p$ was set at between 5 and 10 actuators, i.e., if a spacing of 5 is selected, there are five actuators between the probed actuator and its respective pinning actuators.

Following the selection of a CD actuator y*(h) to be probed and the CD actuator range defined by actuators $y_L$*(h) and $y_U$*(h), the next step is identification of the mapping alignments corresponding to CD actuators y*(h), $y_L$*(h) and $y_U$*(h). The mapping alignments corresponding to CD actuators y*(h), $y_L$*(h) and $y_U$*(h) are represented by χ(y*(h)), χ($y_L$*(h)) and χ($y_U$*(h)) respectively. The mapping alignment χ are the CD databoxes $x_i$ identified in the mapping matrix M, from Equation 2, corresponding to the CD actuator numbers y*(h), $y_L$*(h) and $y_U$*(h). The mapping alignment χ(y*(h)) is the CD controller parameter that is adjusted during the probing steps for optimizing the local control performance. The mapping alignments χ($y_L$*(h)) and χ($y_U$*(h)) are CD controller parameters used in the determination of local performance for the probing. The latter two mapping alignments are also used in the local updating of CD actuators surrounding the probed CD actuator y*(h) while this actuator mapping alignment is being adjusted.

Figure 9:
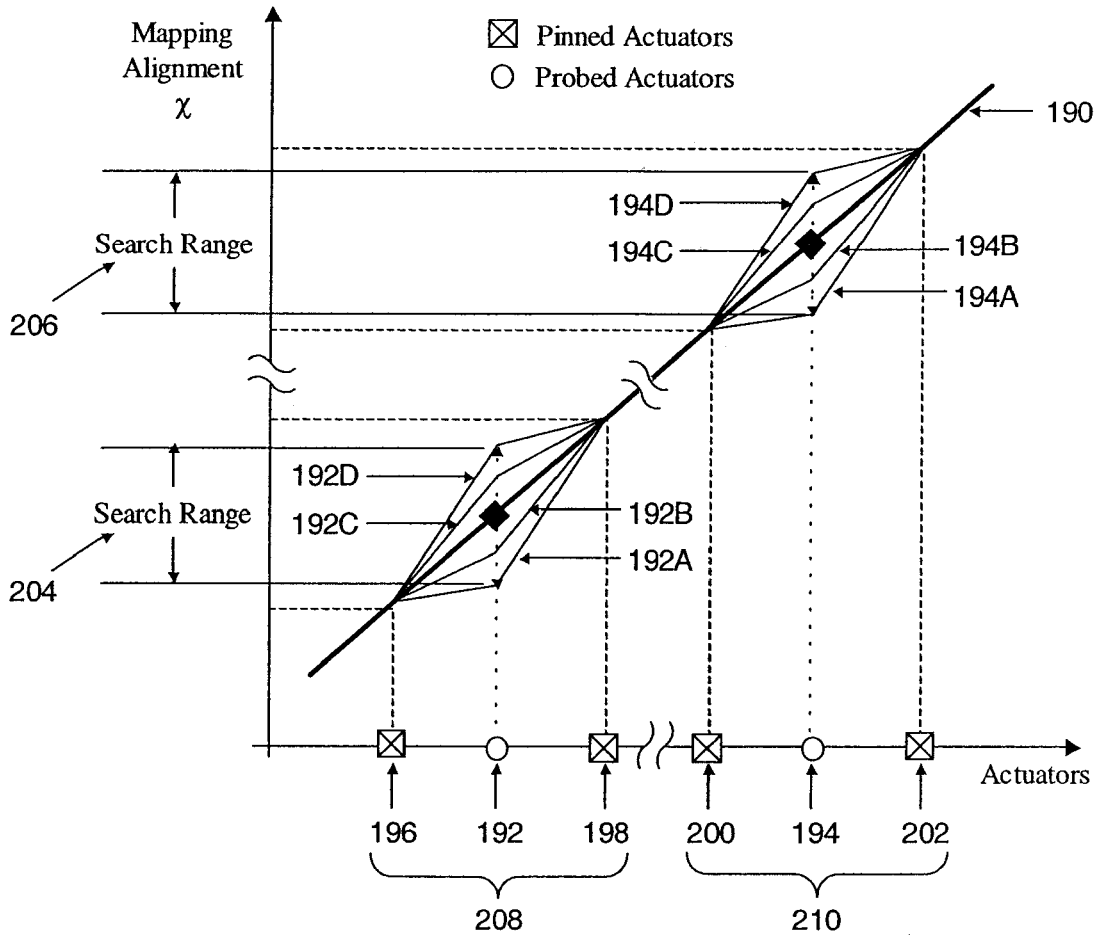
FIG. 9 graphically illustrates probing techniques of the present application.

As illustrated in FIG. 9, the diagonal line 190 represents the current alignment in the CD controller between the CD actuators $y_j$ shown on the horizontal axis and the mapping alignment in the measured CD profile on the vertical axis. The open circles along the horizontal axis represent actuators y*(h) 192, 194 to be probed and correspond to regions manually or automatically identified as having developing mapping problems. The squares along the horizontal axis represent pinning actuators 196, 198, 200, 202 chosen by the user specified single-sided spacing distance $D_p$ from the probed actuators 192, 194. Actuators 196 and 198 are pinning actuators for probed actuator 192, and actuators 200 and 202 are pinning actuators for probed actuator 194.

With the pinning actuators 196, 198 (200, 202) defined for the probed actuator 192 (194), the mapping alignment χ(y*(h)) for the probed actuator 192 (194) is changed to mark out the performance curve 180 illustrated in FIG. 7. While the mapping alignment for the probed actuator 192 (194) is changed, the mapping alignment values χ($y_L$*(h)) and χ($y_U$*(h)) for the pinning actuators 196, 198 (200, 202) are held fixed at the values corresponding to the moment when the actuators were selected to be pinning actuators. The mapping alignment values for all actuators between the probed actuator 192 (194) and pinning actuator 196 (200) are linearly interpolated between the mapping alignment values corresponding to those two actuators and the mapping alignment values for all actuators between the probed actuator 192 (194) and pinning actuator 198 (202) are linearly interpolated between the mapping alignment values corresponding to those two actuators, as illustrated by 192A-D (194A-D) in FIG. 9.

The probed actuator mapping alignment is changed in discrete steps over a single-sided mapping alignment search range $D_{sr}$. The number of discrete steps is limited to a maximum, single-sided number of discrete steps $N_s$. Both the maximum, single-sided number of discrete steps $N_s$ and the single-sided mapping alignment search range $D_{sr}$ are stopping conditions for adjusting the mapping alignment value of the probed actuator. The maximum, single-sided number of discrete steps $N_s$ and the single-sided mapping alignment search range $D_{sr}$ are user specified. The mapping alignment for the probed actuator is changed in directions that both decrease and increase the mapping alignment value relative to the value that corresponds to the moment when the probed actuator was identified by the monitoring aspect of the present application.

When the value of the mapping alignment is decreased, the mapping alignment value is not permitted to be less than the mapping alignment value that results in subtracting the mapping alignment search range $D_{sr}$ from the mapping alignment value that corresponds to the moment when the probed actuator was identified by the monitoring aspect. When the value of the mapping alignment is increased, the mapping alignment value is not permitted to be greater than the mapping alignment value that results in adding the mapping alignment search range $D_{sr}$ to the mapping alignment value that corresponds to the moment when the probed actuator was identified by the monitoring aspect. The number of discrete steps executed in either the decreasing or increasing value change steps is limited to the maximum, single-sided number of discrete steps $N_s$. In the illustrated embodiment, a value of 6 to 8 is used for the maximum, single-sided number of discrete steps $N_s$ and a CD databox number equaling 2 to 3 times the CD actuator mapping alignment span between two consecutive CD actuators is used for the mapping alignment search range $D_{sr}$. The absolute step size of the mapping alignment value on each of the discrete steps is equal to the search range $D_{sr}$ divided by the maximum number of discrete steps $N_s$.

To aid in the description of adjusting the mapping alignment value in a decreasing direction and an increasing direction, the following parameter is introduced:

$$\varepsilon(y^*(h), \zeta(l)) = \chi(y^*(h), l) - \chi(y^*(h), 0) \tag{25}$$

$$\chi(y^*(h), l) = \chi(y^*(h), 0) + l \cdot \frac{D_{sr}}{N_s} - (N_s) \le l \le N_s$$

where

χ(y*(h),0)=mapping alignment value for the probed actuator corresponding to the moment when the probed actuator was picked by the monitoring aspect.

χ(y*(h),l)=mapping alignment value for the probed actuator on the l-th step of the probing process and in the direction denoted by the sign of l. A negative l value means that the mapping alignment value is decreasing. A positive l value means that the mapping alignment value is increasing.

$D_{sr}$=mapping alignment search range.

$N_s$=maximum number of discrete probing steps to be taken in either the decreasing or increasing direction.

ζ(l)=stepping count for probing in both increasing and decreasing directions

To further aid in the description of adjusting the mapping alignment value in a decreasing direction and an increasing direction, the notation in Equation 25 will also be written in the following form:

$$\epsilon_l \equiv \epsilon(y^*(h), \zeta(l)) \tag{26}$$

At each discrete step in the mapping alignment of the probed CD actuator 192 (194), the process is allowed to settle and data is collected to represent the local variability of the CD profile segment corresponding to the mapping alignment region spanning between the pinning actuators 196, 198 (200, 202) of the probed CD actuator 192 (194).

The location of the mapping alignment for the probed actuator 192 (194) is moved in a first direction until the edge of the "insensitivity" region is determined by a rise in the local variability. The location of the mapping alignment is then returned to the location where probing started. The mapping alignment is then moved in discrete steps in a second direction, opposite to the first direction, so that the entire performance curve 180 for the probed actuator is determined. It is noted that even though the mapping alignment is continually being changed, the mapping alignment is only outside the "insensitivity" region for a short period of time so that the probing operation has minimal impact upon the process.

When the performance curve 180 has been completely determined, the edges of the "insensitivity" region are apparent. The optimal mapping alignment for the probed actuator 192, 194 is in the center of the "insensitivity" region where small changes in the web due, for example, to drying and shrinkage of the sheet will have little impact upon the performance of the CD control.

After a CD actuator has been identified for probing, a performance measure corresponding to that CD actuator is defined. The performance measure used in the illustrated embodiment is based on the range of CD profile data boxes between the mapping alignments corresponding to the pinning actuators for the probed actuator, or between mapping alignments $\chi(y_L^*(h))$ and $\chi(y_U^*(h))$. This range of CD profile data boxes is used to determine the local variability for a specified number of scans $Z_{sc}$ at a particular mapping alignment, $\epsilon_l$ setting. The local variability for each of the $Z_{sc}$ scans is calculated as follows:

$$\bar{e}(z_k) = \frac{1}{x_b - x_a + 1} \cdot \sum_{x_i = x_a}^{x_b} e(x_i, z_k) \tag{27}$$

$$\sigma(y^*(h), \varepsilon_l, z_k) = \sqrt{\frac{\sum_{x_i = x_a}^{x_b} [e(x_i, z_k) - \bar{e}(z_k)]^2}{x_b - x_a + 1}}$$

where $e(x_i, z_k)$=high-resolution CD error profile element at CD position $x_i$ of profile sample $z_k$.

$x_a = \chi(y_L^*(h))$, low bound of CD position $x_i$.

$x_b = \chi(y_U^*(h))$, upper bound of CD position $x_i$.

$\bar{e}(z_k)$=mean value of the high-resolution CD error profile element $e(x_i, z_k)$ over the CD position range of a and b.

$\sigma(y^*(h), \epsilon_l, z_k)$=local variability for the high-resolution CD error profile sample $z_k$, over a local profile region corresponding to probed actuator y*(h), and for the l-th step of the optimization search of the mapping alignment setting $\epsilon_l$.

After the specified number of scans $Z_{sc}$ has been collected, a performance measure $J(y^*(h), \epsilon_l)$ and a tolerance limit $T(y^*(h), \epsilon_l)$ are calculated from all local variability samples $\sigma(y^*(h), \epsilon_l, z_k)$. The performance measure is calculated as the mean value of all local variability samples $\sigma(y^*(h), \epsilon_l, z_k)$ and the tolerance limit is calculated as the variability for all local variability samples $\sigma(y^*(h), \epsilon_l, z_k)$.

$$J(y^*(h), \varepsilon_l) = \frac{1}{Z_{sc}} \cdot \sum_{k=1}^{k=Z_{sc}} \sigma(y^*(h), \varepsilon_l, z_k) \tag{28}$$

$$T(y^*(h), \varepsilon_l) = \sqrt{\frac{\sum_{k=1}^{k=Z_{sc}} [\sigma(y^*(h), \varepsilon_l, z_k) - J(y^*(h), \varepsilon_l)]^2}{Z_{sc}}}$$

The parameter $\epsilon_l$ setting is then changed and the sequence is repeated after the process has settled at the new epsilon setting.

In order to determine when to stop introducing mapping alignment changes into the CD controller in the first direction of probing, a minimum performance measure $J_{min}(y^*(h), \epsilon_{l+(-1)sgn(l)})$ and a minimum tolerance limit $T_{min}(y^*(h), \epsilon_{l+(-1)sgn(l)})$ are calculated at each stepping change to the epsilon setting. The minimum performance measure and the minimum tolerance limit are combined to generate a stepping threshold $T_{step}(y^*(h), \epsilon_{l-1})$ $$T_{step}(y^*(h), \epsilon_{l+(-1)\cdot sgn(l)}) = J_{min}(y^*(h), \epsilon_{l+(-1)\cdot sgn(l)}) + T_{min}(y^*(h), \epsilon_{l+(-1)\cdot sgn(l)}) \tag{29}$$

When the performance measure for the current mapping setting step $\epsilon_l$ exceeds the stepping threshold $$J(y^*(h), \epsilon_l) > T_{step}(y^*(h), \epsilon_{l+(-1)\cdot sgn(l)}) \tag{30}$$

then no further epsilon changes are made in that direction. This stopping check is not performed against the performance measure corresponding to the mapping setting at the start of the optimization, before the first probing step is applied, because this performance measure represents a benchmark of the current mapping setting. When the stepping direction is changed, determination of the minimum performance measure, the minimum tolerance limit, and the stepping threshold starts over for the second search direction.

The minimum performance measure is determined at each step of the mapping setting to be the minimum value among all performance measures calculated on the preceding steps of the mapping setting for the current probing direction $$J_{min}(y^*(h), \epsilon_l) = \min\{J(y^*(h), \epsilon_0), J(y^*(h), \epsilon_1), J(y^*(h), \epsilon_2), \ldots, J(y^*(h), \epsilon_{l-1}),\} \tag{31}$$

where $J(y^*(h), \epsilon_0)$=performance measure corresponding to the mapping setting at the start of the optimization, before the first probing step is applied.

$J(y^*(h), \epsilon_1)$=performance measure corresponding to the mapping setting after the first probing step is applied.

$J(y^*(h), \epsilon_{l-1})$=performance measure corresponding to the mapping setting after the (l−1)-th probing step is applied.

l=current probing step.

The minimum performance measure is not calculated for the starting value of the mapping setting because the starting value represents a benchmark of the current performance. The minimum performance measure calculated on the first step in the current direction is equal to the performance measure calculated for starting value (benchmark) of the mapping setting. The minimum performance measure calculated on the second step in the current direction, where two preceding performance measure values exist, is equal to the minimum value of the two available values. This updating method for determining the minimum performance measure continues until the search in the current direction is terminated.

The minimum tolerance limit is determined at each step of the epsilon setting to be the mean value of all tolerance limits calculated on the preceding steps of the mapping setting for the current probing direction and with a user specified gain $K_T$ applied $$T_{\min}(y^*(h), \varepsilon) = \frac{K_T}{l} \cdot \sum_{s=0}^{l-1} T(y^*(h), \varepsilon_s) \tag{32}$$

where $T(y^*(h), \epsilon_0)$=tolerance limit corresponding to the mapping setting at the start of the optimization, before the first probing step is applied.

$T(y^*(h), \epsilon_1)$=tolerance limit corresponding to the mapping setting after the first probing step is applied.

$T(y^*(h), \epsilon_{l-1})$=tolerance limit corresponding to the mapping setting after the (l−1)-th probing step is applied.

l=current probing step.

$K_T$=gain used to adjust the magnitude of the tolerance limits. If the gain is too small, probing in the current stepping direction may stop too early. If the gain is too large, probing in the current stepping direction may deviate too far from the starting value of the mapping setting. In the illustrated embodiment of the present application, the gain $K_T$ is set to a value between 2 and 3.

The minimum tolerance limit is not calculated for the starting value of the mapping setting because the starting value represents a benchmark of the current performance. The minimum tolerance limit calculated on the first step in the current direction is equal to the tolerance limit calculated for starting value (benchmark) of the mapping setting. The minimum tolerance limit calculated on the second step in the current direction, where two preceding tolerance limits exist, is equal to the mean value of the two available tolerance limit values. This updating method for determining the minimum tolerance limit continues until the search in the current direction is terminated.

Figure 10A:
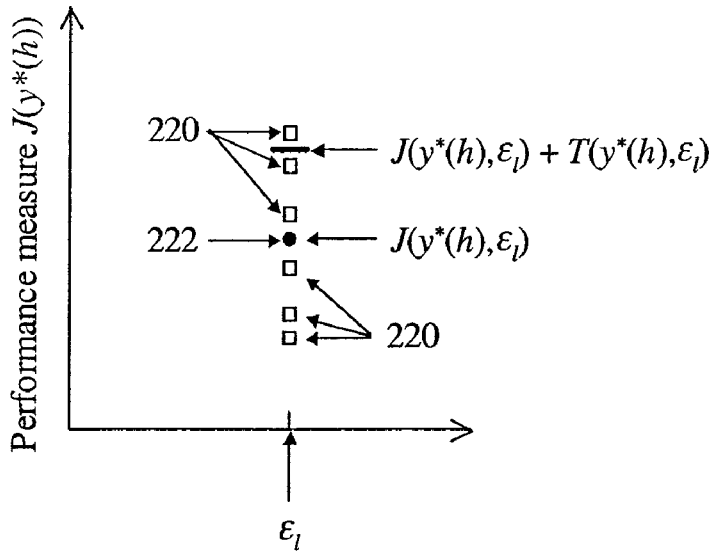
FIG. 10A illustrates local variability results for six scans at a given mapping alignment setting (epsilon value) being probed and a performance measure for the local variability.

The local variability for a specified number of scans $Z_{sc}$, six as illustrated, are shown by boxes 220 in FIG. 10A which also shows the performance measure 222 and the tolerance limit calculated for the starting mapping alignment setting and the mapping alignment setting after the first step is applied. It is noted, and previously mentioned, that for the first mapping alignment setting step $\epsilon_1$, only one set of performance measure and tolerance limit are available for the determination of the minimum performance measure and minimum tolerance limit. After the performance curve point has been established for the first mapping alignment setting step, the mapping alignment setting is stepped and the sequence is repeated. Calculation of the second and following minimum performance measure and minimum tolerance limit is based on all the sets of performance measure values and tolerance limit values from the mapping alignment setting steps for the first, second, third, etc. up to the mapping alignment setting step prior to the current mapping alignment setting such that the minimum performance measure and the minimum tolerance limit evolve throughout the probing.

Figure 10B:
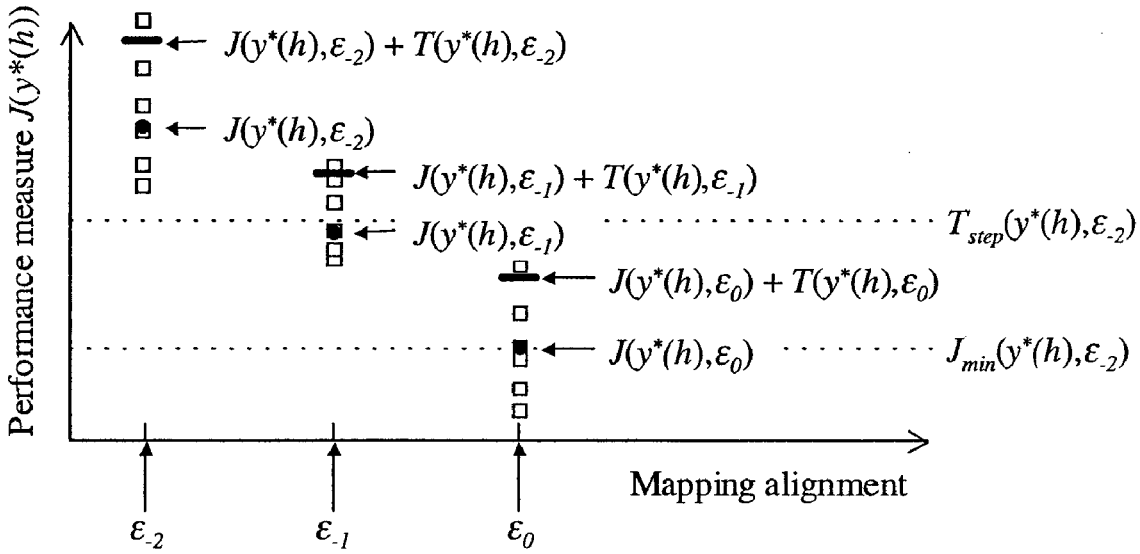
FIG. 10B illustrates an example of a stepping threshold that is used for stopping a mapping probe operation after probing at a second epsilon value setting.

The diagram of FIG. 10B shows an example of the threshold for stopping a mapping probe after probing at a second epsilon value setting. It is noted that in FIG. 10B, the mapping alignment settings (epsilons) are being decreased and hence move to the left and the minimum performance measure is equal to the performance measure for the mapping setting $\epsilon_0$ and that the stepping threshold for stopping the mapping probe is equal to $T_{step}(y^*(h),\epsilon_{-2})$ which is the minimum performance measure plus the minimum tolerance limit.

Figure 11:
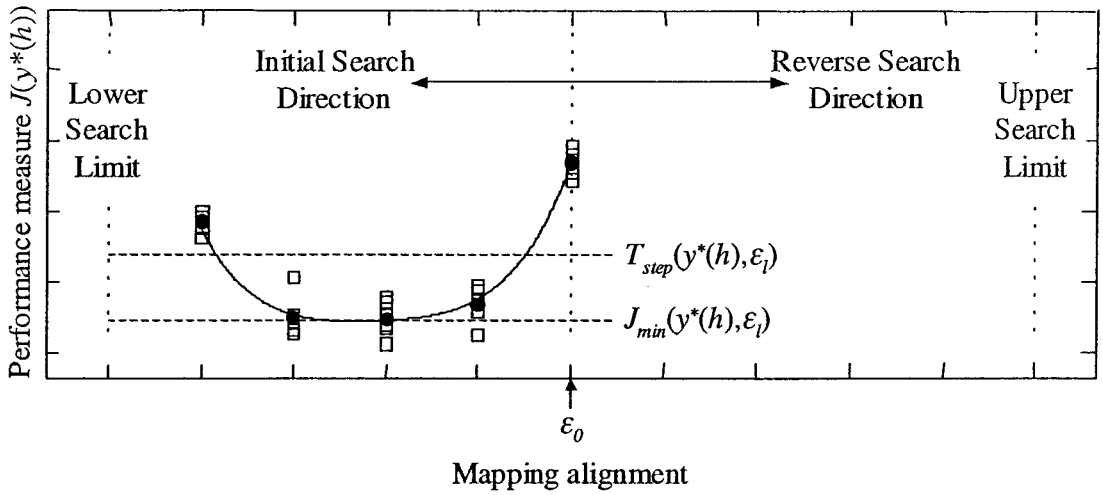
FIG. 11 illustrates termination of a probing search in a first or initial direction due to the performance measure exceeding the stepping threshold with no probing in the second direction.
Figure 12:
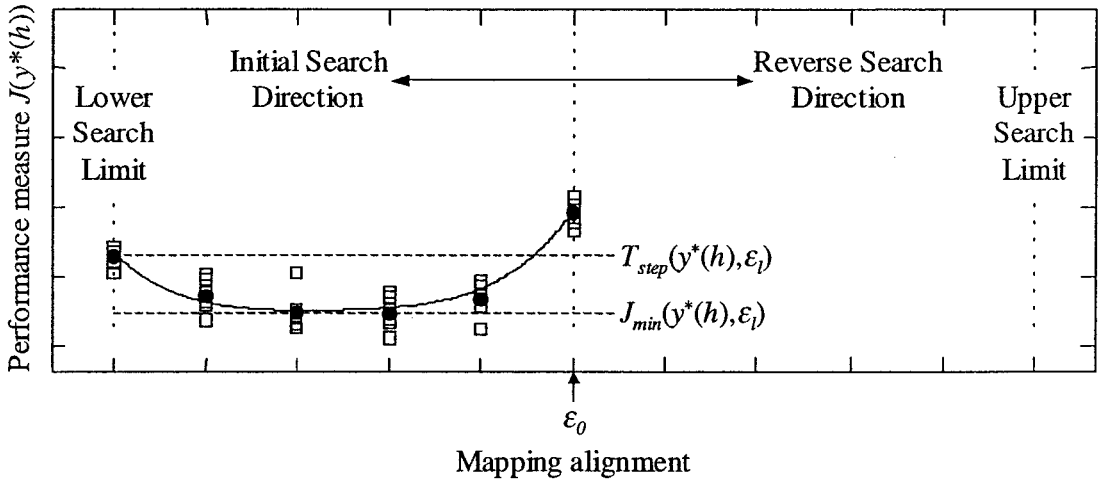
FIG. 12 illustrates termination of a probing search in a first or initial direction due to reaching a user set hard limit or number of mapping alignment steps with no probing in the second direction.

Probing continues in the initial direction until the performance measure for the mapping alignment step either exceeds the stepping threshold (which can occur on the first mapping alignment step if the starting point is on an edge of the "insensitivity" region) or a user specified number of mapping alignment steps or search range has been exceeded. Thus, if the stepping threshold is not violated, there are hard limits, defined by $D_{sr}$, that stop the changes in epsilon during a probing operation. Once probing or searching is stopped in the initial direction, a check is made to determine if there is a need to search in the other direction, i.e., search the other side of the performance curve. If the performance measure corresponding to the starting value of the mapping alignment, before any mapping alignment steps are made, is above the stepping threshold, i.e., minimum performance measure plus the minimum tolerance limit, there is no need to search the other side of the curve. A performance measure corresponding to the starting value of the mapping alignment above the stepping threshold indicates that a well-defined descending edge exists on the other side of the probing starting point on the performance curve. Two illustrative examples are shown in FIGS. 11 and 12. In FIG. 11, the search in the initial direction of decreasing epsilon value is terminated by the performance measure on the last mapping alignment step exceeding the stepping threshold. In FIG. 12, the search in the initial direction of decreasing the epsilon value is terminated by reaching the hard limit or number of mapping alignment steps set by the user. In both FIGS. 11 and 12, the performance measure corresponding to the starting value of the mapping setting is above the stepping threshold, so that no probing is done in the reverse direction or in the direction of increasing the epsilon value.

Figure 13:
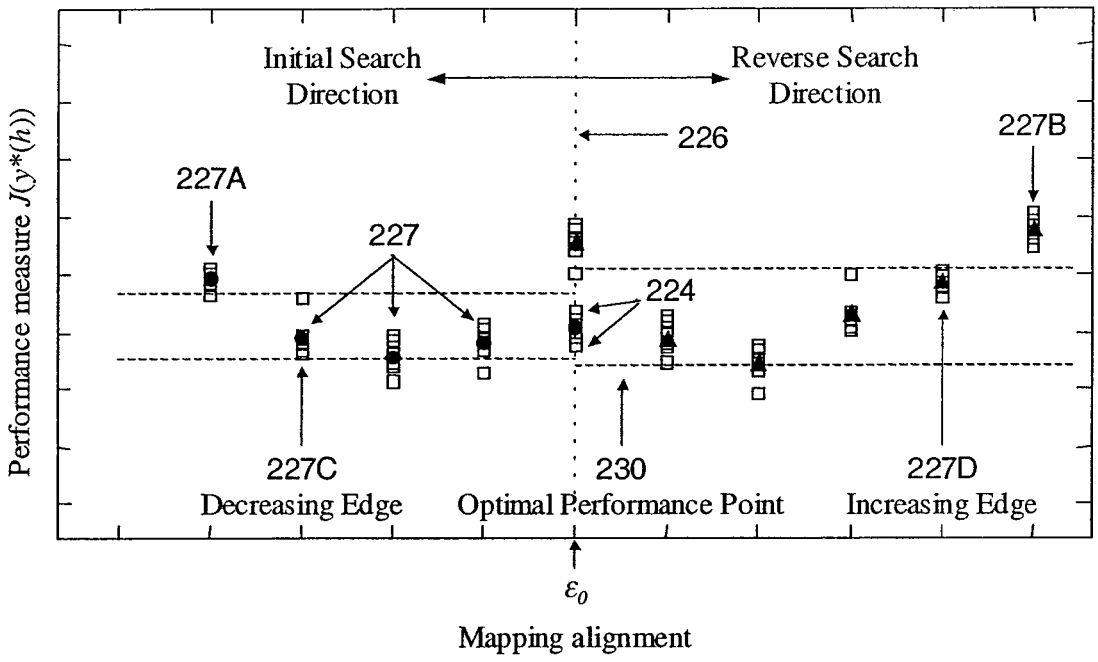
FIG. 13 illustrates actuator probing that goes from one side of the performance curve to the other side of the performance curve, i.e., probing in both the first and second directions, with probing being stopped by exceeding the stepping threshold.

An example of actuator probing that goes from one side of the performance curve to the other side of the performance curve and is stopped by exceeding the stepping threshold as described above is shown in FIG. 13. For actuator probing, a performance measure and tolerance limit is determined from the local variabilities 224 as benchmarks for the starting point 226. Probing is then started in a first direction, to the left as shown in FIG. 13 (although initial probing could be to the right to increase the mapping alignment settings), to decrease the mapping alignment settings (epsilon values) with probing being stopped when the performance measure for the epsilon value exceeds the stepping threshold. Since the performance measure of the local variability at the starting epsilon value after probing in the first direction has been stopped is not above the stepping threshold at the conclusion of probing in the first direction, the other side of the performance curve is probed or searched. Probing in the second direction, the right as shown in FIG. 13, to increase the epsilon value, is started afresh by taking a new benchmark for the starting point 226. A new benchmark is taken to ensure accurate probing in the second direction. Probing is stopped when the performance measure for the epsilon value exceeds the stepping threshold in the second probing direction. The outermost points 227A, 227B of the performance curve 227 are defined by the two stop probing points with the edges of the "insensitivity" region 227C, 227D, i.e., optimal range for the probed actuator mapping alignment, being defined by the last performance measure within the stepping threshold or hard limit.

Once the performance curve 227 has been generated, the optimal performance point 230 is identified as shown in FIG. 13 and used as the mapping alignment for the probed actuator. The optimal point 230 is determined based on the midpoint between the left and right sides 227C, 227D of the increasing edges of the performance curve 227. The sides of the performance curve are defined as the point on the curve where the last performance measure is still within the stepping threshold or hard limit.

Normally, mapping misalignment does not result in the profile going bad at just one point across the profile. Rather, several profile points often go bad as a result of mapping misalignment. However, the problem is that the mapping misalignment rarely starts to go bad at different profile points at the same time. As a result, the probing and monitoring routines continue to work together after initial probing has begun and new probing areas that are identified are received by the probing routine from the monitoring routine and processed while probing of previously identified probing areas is taking place. This is illustrated in the FIG. 14.

Figure 14:
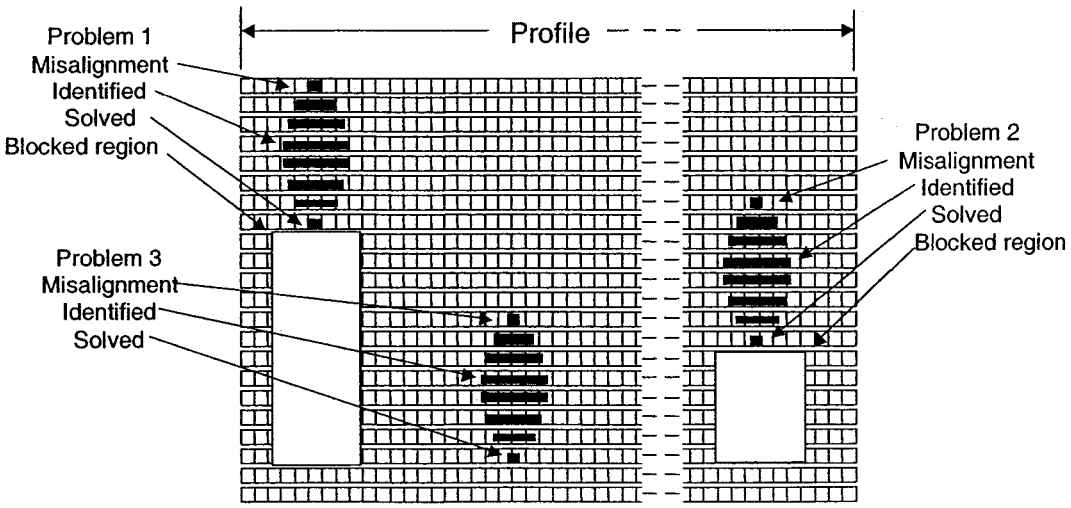
FIG. 14 illustrates that probing and monitoring routines of the present application continue to work together after initial probing has begun so that new probing areas are received and processed while probing is taking place.

Notice in FIG. 14 that problem 2 starts before problem 1 has been resolved and problem 3 starts before problem 2 has been resolved. Once a problem has been resolved, the corresponding probing area cannot be reintroduced as a mapping problem until an entire probing sequence has been completed. Otherwise, the probing sequence may never stop. A probing sequence is completed after all areas to be probed have been resolved or after there are no further areas of the profile to be monitored, i.e., the blocking operations after probing profile has been blocked to the point that monitoring is not effective.

Figure 15:
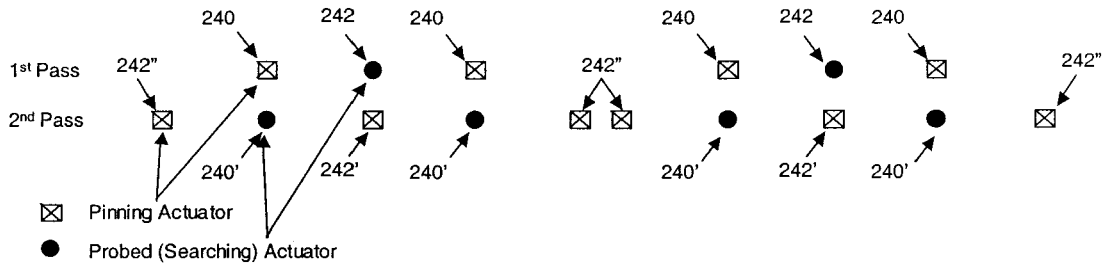
FIGS. 15 and 16 illustrate two pass optimization in accordance with the present application.
Figure 16:
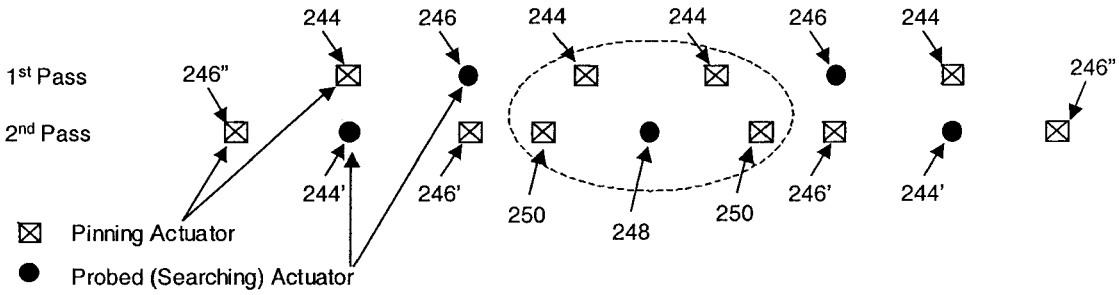

Once a probing operation or optimization has been completed, a second related optimization can be performed. Each time an actuator is introduced into the probing routine, a set of pinning actuators are set based on the user specified pinning window width such that the probed actuator is centered between the pinning actuators. In some instances, it is possible that probing can result in mapping misalignment at the pinning locations of a first optimization pass. As a result, performance can be further improvement by running a second optimization pass using the pinning actuators as the probed actuators in the second pass. Such a second optimization process is illustrated in FIGS. 15 and 16. In FIG. 15, the pinning actuators 240 in the first pass become the probed actuators 240' in the second pass. Similarly, the probed actuators 242 in the first pass become pinning actuators 242' for the second pass. Since the original pinning actuators 240 must be surrounded by pinning actuators when they are probed, additional pinning actuators 242" are selected based on the user specified pinning window width for the probed actuators 240'.

In FIG. 15, the closest adjacent pinning actuators 240 (the two central pinning actuators 240) in the first optimization pass are spaced so that when a second optimization pass is made to probe the pinning actuators 240', the generally centered additional pinning actuators 242" permit proper probing. In FIG. 16, this is not the case. In FIG. 16, two outermost pinning actuators 244 in the first pass become probed actuators 244' in the second pass with the probed actuators 246 in the first pass become pinning actuators 246' for the second pass. Since the original pinning actuators 244' must be surrounded by pinning actuators when they are probed, additional pinning actuators 246" are selected based on the user specified pinning window width for the probed actuators 246" as in FIG. 15. However, the spacing between the central pinning actuators 244 in the first pass is such that they cannot be individually probed. Accordingly, an intermediate actuator 248, centered between the pinning actuators 244 in the first pass, is selected to be probed in the second pass. Pinning actuators 250 for the probed actuator 248 are selected based on the user specified pinning window width. Probing during a second optimization pass is the same as for a first optimization pass as described above except for the selection of the pinning and probed actuators.

After either a first optimization pass or an optional second optimization pass, a global smoothing operation also can be performed selectively. That is, the user can select to have a second optimization pass and also whether to perform a smoothing operation after optimization has been performed. The smoothing factor is the upper bound of the second order difference of the actuator setpoints, the same factor that is used in referenced patent application Ser. No. 09/592,921 for global profile performance optimization, now U.S. Pat. No. 6,564,117. For global smoothing, the smaller the smoothing factor, the less second order difference is permitted for a CD actuator. An unbounded smoothing factor can result in over-control of the profile, leading to higher frequency variation in the sensor profile. An over-bounded smoothing factor can restrict an actuator setpoint to the extent that the setpoint vector is flat, resulting in no control actions taken for deviations in the sensor profile.

The global smoothing search operates in a manner similar to the local (mapping) optimization. However, the parameter being optimized to improve performance of the CD controller is a single global smoothing factor b(l) instead of a set of CD actuator mapping alignments. In the CD controller that the current application is applied to, the single global smoothing factor is limited to the value range of zero (0) and one (1), where zero corresponds to completely over-bounding the actuator setpoints and one corresponds to completely unbounding the actuator setpoints. Since the global smoothing factor affects the second order difference for all CD actuator setpoints and the CD actuators as a whole affect the full width CD profile, the performance measure for global smoothing search is the variability of the full width CD profile, again the same as in referenced patent application Ser. No. 09/592,921, now U.S. Pat. No. 6,564,117, instead of a local CD profile variability. However, the processes for updating the parameter being optimized, stopping updating of the parameter being optimized and analyzing the resultant curve are identical to those for the mapping optimization.

Specific to the global smoothing search, in the step of defining the values corresponding to the lower and upper search range, a lower global smoothing factor ($b_{ll}$) and an upper global smoothing factor ($b_{el}$) are explicitly specified. The explicit declaration of the search ranges allows the global smoothing search to probe more in one direction than the other if the starting value of the global smoothing factor is not centered within the absolute limits of zero (0) and one (1). With the maximum, single-sided number of discrete steps $N_s$ being the same as in the mapping optimization, explicitly specified search limits results in a two-sided stepping size for updating the global smoothing factor in the decreasing and increasing search directions. The two-sided stepping sizes are determined by $$S_{dsz} = \frac{|b_{ll} - b(0)|}{N_s} \qquad (33)$$

$$S_{isz} = \frac{|b_{ul} - b(0)|}{N_s}$$

where $S_{dsz}$=decreasing step size.

$S_{isz}$=increasing step size.

$N_s$=maximum, single-sided number of discrete steps.

$b_{ll}$=lower limit of search range.

$b_{ul}$=upper limit of search range.

b(0)=starting value of global smoothing factor before any decreasing or increasing steps are applied.

Relating now to Equation 25, the epsilon parameter in the global smoothing search can be represented as $$\varepsilon(\zeta(l)) = b(l) - b(0) \tag{34}$$

$$b(l) = \begin{cases} b(0) + l \cdot S_{dsz}, & -(N_s) \le l \le 0 \\ b(0) + l \cdot S_{isz}, & 0 < l \le N_s \end{cases}$$

where b(0)=starting value of global smoothing factor before any decreasing or increasing steps are applied.

b(l)=global smoothing factor value on the l-th step of the probing process and in the direction denoted by the sign of l. A negative l value means that the mapping alignment value is decreasing. A positive l value means that the mapping alignment value is increasing.

$S_{dsz}$=decreasing step size.

$S_{isz}$=increasing step size.

ζ(l)=stepping count for probing in both the decreasing and increasing directions.

The shorthand notation $\epsilon_l$ for representing epsilon remains the same.

Specific to the global smoothing search, in the step of determining the performance measure corresponding to each setting of the global smoothing factor, the variability of the full width CD profile is evaluated. With the number of scans $Z_{sc}$ of CD profiles analyzed after the probing step is allowed to settle being the same as in the mapping optimization, the CD databox numbers assigned to $x_a$ and $x_b$ in Equation 27 are equated to the lowest CD databox number with profile data and the highest CD databox number with profile data, respectively. The range between the newly defined values of $x_a$ and $x_b$ is the full width CD profile. For an individual skilled in the art, the step of determining the performance measures and tolerance limits at each probing step; the step of determining minimum performance measures, minimum tolerance limits and stepping threshold; the step of determining the stopping condition for probing in the first search direction with either the performance measure exceeding the stepping threshold or the hard limit being reached; the step of determining whether the second probing direction is performed; the step of performing the second probing direction; the step of marking out the performance curve; and, the step of determining the optimal setting for the global smoothing factor can be executed for the global smoothing search without further detailed description.

The invention of the present application uses both spatial (CD profile) and temporal (MD history) analyses to determine if a local profile problem is starting to develop. The techniques enable local profile problem areas to be detected before they become apparent in the process. The local indicators act as triggers to allow for immediate probing for profile solutions in the local profile areas found. This is a substantial departure from existing techniques that use global profile optimization triggers.

The invention of the present application also has the ability to distinguish between a persistent shape and a shape that is evolving. Accordingly, probing sequences will not trigger on persistent shapes so that only problems that are real and developing are addressed. This is a substantial departure from existing technology where monitoring sections of the profile having persistent problems must be disabled so that they are not repeatedly detected.

Profile problems do not have to develop at the same time for the invention of the present application to find and correct them. Rather, problems are found and resolved as they occur. Once a local profile problem is found by monitoring the web, the problem is associated with an actuator and is probed. However, if a problem occurs at another profile point during the probing of the initial problem, that problem is identified and also probed for optimal mapping alignment for the new location as well. The only limit is the number of actuators. The ongoing identification of problems as they arise is a substantial departure from existing technology.

Existing pattern recognition techniques are often sensitive to the grade of paper being manufactured. However, the invention of the present application normalizes the pattern recognition analysis results such that they are process independent so that it is a robust program that is easy to setup and use.

Existing technology presumes that performance curves have a "V" cross-section. Rather, the inventors of the present application have recognized that instead of a "V" cross section, the cross section is more of a "___/" shape. Accordingly, all small changes in a manipulated variable that generates the performance curve will not cause a change in performance. Because existing presumptions about the performance curve can result in marginally stable systems, the invention of the present application generates the actual performance curve for each manipulated variable that has been identified as causing a profile problem and uses that performance curve to select an optimal CD mapping.

Since small changes in the center of the performance curve produce small or no change in profile performance, but small changes at the edges of the performance curve can cause significant process degradation, the invention of the present application stops changing the manipulated variable before the process degrades.

After the performance curve has been generated, the invention of the present application locates the optimal point and then adjusts the manipulated variable such that optimal performance is realized.

Memory usage is often a deterrent to implementing theoretical solutions. However, for the invention of the present application, several recursive calculations can be used to minimize memory usage and therefore reduce the need for historical data storage of profile and analysis results.

In the invention of the present application, probing time is reduced by up to 10 scans by storing an MD history of profiles. Then, when the web monitor routine finds a mapping misalignment problem, the probing routine can immediately determine the initial conditions from the historical buffer so that probing can immediately begin rather than having to wait for an initialization period to be completed.

Once a local profile point has been optimized, that point is updated in the global actuator to profile alignment arrays. However, if this point is significantly different than the current location, a discontinuity can result in the global actuator and profile alignment near the optimal point found. The invention of the present application can be operated to identify the optimal locations at this discontinuity and effectively "smooth" the global actuator and profile alignment array such that overall actuator to profile alignment can be achieved. Once a global actuator and profile alignment has been achieved, the invention of the present application uses them as the starting point for the next monitoring/probing actions. The result over time is a convergence towards the optimal actuator to profile alignment.

Having thus described the invention of the present application in detail and by reference to preferred embodiments thereof, it will be apparent that modifications and variations are possible without departing from the scope of the invention defined in the appended claims.

What is claimed is:

1. Apparatus for controlling cross-machine direction (CD) mapping in a web making machine, said apparatus comprising:

a sensor for monitoring said web making machine; and a controller programmed to perform the operations of:

monitoring a web making machine;

generating at least two web analysis profiles from data representative of said web making machine;

combining a first one of said at least two web analysis profiles with a second one of said at least two web analysis profiles;

identifying a developing CD mapping problem of misalignment in a cross direction spatial relationship between CD actuators and a CD profile from said combination of a first one of said at least two web analysis profiles with a second one of said at least two web analysis profiles;

probing at least one CD actuator corresponding to said identified developing CD mapping problem;

determining an optimal performance point for said at least one CD actuator from results of probing said at least one CD actuator; and adjusting CD mapping for said at least one CD actuator in accordance with said optimal performance point.

2. Apparatus for controlling cross-machine direction (CD) mapping in a web making machine as claimed in claim 1 wherein said controller performs the operation of monitoring a web being produced by said web making machine.

3. Apparatus for controlling cross-machine direction (CD) mapping in a web making machine as claimed in claim 1 wherein said controller performs the operation of monitoring CD actuators extending across said web making machine.

4. Apparatus for controlling cross-machine direction (CD) mapping in a web making machine as claimed in claim 1 wherein said controller performs the operations of:

monitoring a web being produced by said web making machine; and monitoring CD actuators extending across said web making machine.

* * * * *